US011299939B2

(12) United States Patent
Golovinskij

(10) Patent No.: US 11,299,939 B2
(45) Date of Patent: Apr. 12, 2022

(54) SYSTEM AND METHOD FOR SUPPORTING A RISER

(71) Applicant: MAERSK DRILLING A/S, Kgs. Lyngby (DK)

(72) Inventor: Nikolaj Golovinskij, Charlottenlund (DK)

(73) Assignee: MAERSK DRILLING A/S, Kgs. Lyngby (DK)

( * ) Notice: Subject to any disclaimer, the term of this patent is extended or adjusted under 35 U.S.C. 154(b) by 0 days.

(21) Appl. No.: 16/484,413

(22) PCT Filed: Feb. 9, 2018

(86) PCT No.: PCT/EP2018/053317
§ 371 (c)(1),
(2) Date: Aug. 7, 2019

(87) PCT Pub. No.: WO2018/146267
PCT Pub. Date: Aug. 16, 2018

(65) Prior Publication Data

US 2019/0360281 A1 Nov. 28, 2019

(30) Foreign Application Priority Data

Feb. 9, 2017 (DK) ..... PA 2017 00094

(51) Int. Cl.
*E21B 17/01* (2006.01)
*E21B 19/00* (2006.01)
(Continued)

(52) U.S. Cl.
CPC ..... *E21B 19/004* (2013.01); *E21B 17/01* (2013.01); *E21B 19/24* (2013.01); *E21B 15/02* (2013.01)

(58) Field of Classification Search
CPC ..... E21B 17/01; E21B 19/004; E21B 19/24; E21B 15/02
See application file for complete search history.

(56) References Cited

U.S. PATENT DOCUMENTS 3,145,775 A 8/1964 Mccarty
3,189,093 A * 6/1965 De Vries ..... E21B 33/064 166/354
(Continued)

FOREIGN PATENT DOCUMENTS

GB 2525084 10/2015
KR 2016 0025188 3/2016
(Continued)

OTHER PUBLICATIONS

Danish Patent Application No. PA 2017 00094; Danish Search Report dated Jul. 19, 2017; 4 pgs.
(Continued)

*Primary Examiner* — Matthew R Buck
(74) *Attorney, Agent, or Firm* — Lathrop GPM LLP

(57) ABSTRACT

A support system (12; 12') for providing horizontal support to a riser (32) extending downward from a cantilever (18) along a well centre and into a body of water comprising a riser interface (48; 48') and a tether arrangement (50; 50'). The support system (12; 12') is configured to permit asymmetric placement of the riser interface (48; 48') relative to the cantilever (18).

18 Claims, 40 Drawing Sheets

(51) Int. Cl.
*E21B 19/24* (2006.01)
*E21B 15/02* (2006.01)

(56) References Cited

U.S. PATENT DOCUMENTS 3,508,409 A * 4/1970 Cargile, Jr. ..... E02B 17/00 405/195.1
4,231,429 A * 11/1980 Kolpak ..... E21B 7/128 114/264
4,244,663 A 1/1981 Croghan
4,401,398 A * 8/1983 Remson ..... E21B 7/136 166/367
4,505,614 A * 3/1985 Anschutz ..... E21B 17/1007 175/220
4,545,437 A * 10/1985 Denison ..... E21B 17/012 166/345
4,557,332 A * 12/1985 Denison ..... E21B 17/012 166/345
4,616,707 A * 10/1986 Langner ..... E21B 19/006 166/345
4,616,708 A * 10/1986 da Mota ..... E21B 19/002 166/355
4,617,998 A * 10/1986 Langner ..... E21B 19/09 166/345
5,160,219 A * 11/1992 Arlt ..... E21B 19/24 405/195.1
5,479,990 A * 1/1996 Peppel ..... E21B 7/122 166/350
5,950,737 A * 9/1999 Chou ..... E21B 17/01 175/5
6,260,625 B1 * 7/2001 Phan ..... E21B 19/004 166/241.6
6,672,804 B1 1/2004 Hallot et al.
9,376,780 B2 * 6/2016 Perry ..... E02B 17/028
2012/0318517 A1 12/2012 Christensen et al.
2016/0032659 A1 2/2016 Kannegaard et al.

FOREIGN PATENT DOCUMENTS

KR 2016 0025189 3/2016
WO WO 2011/059340 A2 5/2011

OTHER PUBLICATIONS

International Patent Application No. PCT/EP2018/053317, International Search Report and Written Opinion dated Apr. 30, 2018, 10 pgs.

* cited by examiner

SYSTEM AND METHOD FOR SUPPORTING A RISER

CROSS-REFERENCE TO RELATED APPLICATIONS

This application is a 35 U.S.C. § 371 filing of International Application No. PCT/EP2018/053317 filed Feb. 9, 2018, which claims the benefit of priority to Danish Patent Application No. PA 2017 00094 filed Feb. 9, 2017, each of which is incorporated herein by reference in its entirety.

FIELD

The present disclosure relates to a system and method for supporting a riser extending into the sea from an offshore platform.

BACKGROUND

In the offshore oil and gas industry well operations are performed from specialised platforms or vessels, known colloquially as "rigs". Multiple types of rig exist, such as fixed platforms, jack-ups, semi-submersibles, ships, barges and the like. The particular type of rig used can depend on a number of factors, such as water depth, rig availability, expected longevity of the associated reservoir, and the like.

Once a well has been drilled and appraised, it will be completed with the appropriate downhole infrastructure to permit production (and/or injection), and then capped at the wellhead with a production tree, known as a X-mas tree. Such completion operations may be achieved from the same rig used during drilling, or may be achieved using a different service rig.

In some applications, the wellhead and production tree are located subsea, with a suitable tie-back to a surface production facility. In other applications, the wellhead and production tree are located topside, with a conductor pipe extending from a topside wellhead facility and into the seabed.

It may be necessary to gain access to an existing well, for example to perform intervention operations, for abandonment purposes and the like. Such access requires a suitable rig to be brought on-site to facilitate the desired operations. For subsea wells, a riser (typically a high pressure riser) will be installed to connect the subsea well back to the rig, with suitable well control equipment, such as a BOP stack, provided at the top of the riser. For topside wells the well control equipment will typically be installed at the top of the existing conductor.

In either case, careful control over the support and stability of the riser/conductor is important while the access operations are being performed. This requirement to provide adequate support and stability to the riser/conductor may restrict the suitability of many available rigs. For example, jack-up rigs may be excluded, and in many cases there will be a preference to utilise specialised ships or semi-submersibles, which may suffer from poor availability and higher costs.

SUMMARY

Aspects of the present disclosure include a support system and method for supporting a riser extending into the sea from an offshore platform, and an offshore platform comprising the support system.

According to a first aspect, there is provided a support system for providing horizontal support to a riser extending downward from a cantilever along a well centre and into a body of water, the support system comprising a riser interface defining a vertical opening for receiving the riser and a tether arrangement for tethering the riser interface to the cantilever, wherein the support system is configured to permit asymmetric placement of the riser interface relative to the cantilever.

Beneficially, examples of the present disclosure provide the ability to adjust the position of the riser interface—and the riser—to any horizontal position relative to the cantilever. Moreover, operations may be carried out with reduced manual interface or with no manual interface, with corresponding reduced risk to personnel operating in the environment.

The support system may be configured to permit symmetric placement of the riser interface relative to the cantilever. For example, in addition to the ability to permit asymmetric placement of the riser interface relative to the cantilever, the support system may be configured to permit symmetric placement of the riser interface relative to the cantilever.

The tether arrangement may be adjustable to adjust the horizontal position of the riser interface.

The tether arrangement may provide horizontal support to the riser interface.

The tether arrangement may comprise a tether.

In particular examples, the tether arrangement may comprise a plurality of tethers.

The tethers may be arranged relative to the riser interface.

The support system may be configured so that each of the tethers is arranged at a given angle relative to the riser interface. In use, each of the tethers may be arranged at a given angle relative to the riser interface so as to permit the position of the riser interface to be adjusted to, and/or to support the riser interface in, any horizontal position relative to the cantilever.

In particular examples, the tether arrangement may comprise four tethers. However, in other examples the tether arrangement may comprise two tethers, three tethers, five or more tethers. The tether arrangement may comprise a port side fore tether. The tether arrangement may comprise a port side aft tether. The tether arrangement may comprise a starboard side fore tether. The tether arrangement may comprise a starboard side aft tether. It will be understood that the terms port, starboard, aft and fore are used to indicate positions relative to the offshore platform.

The tether, or at least one of the tethers, may take the form of a cable. In particular examples, the or each tether may comprise wire rope.

The tether, or at least one of the tethers, may comprise a first portion, e.g. a first cable portion, and a second portion, e.g. a second cable portion.

The tether, or at least one of the tethers, may be adjustable.

The length of the tether may be adjusted.

The tether arrangement may comprise an actuator arrangement.

The actuator arrangement may be configured to adjust the horizontal position of the riser interface.

The actuator arrangement may be configured to support the riser interface.

In particular examples, the actuator arrangement may comprise a hydraulic actuator arrangement.

The actuator arrangement may comprise one or a plurality of actuators.

In particular examples, an actuator is provided for each tether. The actuator may be coupled between the first portion, e.g. the first cable portion, of the tether and the second portion, e.g. the second cable portion, of the tether.

The actuator arrangement may comprise one or a plurality of hydraulic actuators.

Alternatively or additionally, the actuator arrangement may comprise a mechanical arrangement.

The actuator arrangement may comprise one or more turnbuckle, for example.

The tether arrangement may be lockable.

In particular embodiments, the actuator arrangement may be lockable to lock the tether arrangement.

Beneficially, the ability to lock the actuator arrangement provides redundancy in the system, providing two possible mechanisms for adjustment.

In use, the tether arrangement may be operable to locate the riser interface at a desired location, the tether arrangement being lockable to maintain the position of the riser interface at the desired location. Beneficially, examples of the present disclosure permit the riser interface to be located and locked in position before the riser is in place, such that the actuator arrangement is not exposed to loads imparted by the riser. Moreover, examples of the present disclosure also provide safety benefits for personnel, since manual operations may be reduced or eliminated.

The support system may be configured to apply a tensile force to the riser interface.

The tether arrangement may be configured to apply the tensile force to the riser interface.

The support system may be configured to pre-tension the riser interface.

Beneficially, in examples of the present disclosure the actuators can be smaller than otherwise necessary, as they are only used to position and tension the riser interface, and not to position the riser itself.

The support system may be configured to passively provide horizontal support to the riser interface. For example, once installed the support system may passively support the riser interface—and in use the riser. This may be achieved for example by bleeding fluid from the actuators once the required positioning and/or horizontal support has been achieved. Beneficially, the support system does not require complex ongoing and active control systems during operations.

The riser interface may comprise a ring.

The ring may comprise one or a plurality of bores extending therethrough.

The support system may comprise a coupling arrangement for coupling the riser interface to the tether arrangement.

Part of the coupling arrangement for coupling the riser interface to the tether arrangement may be provided on, or form part of, the riser interface.

The riser interface may comprise a plurality of attachment locations.

The attachment locations may be circumferentially arranged and/or spaced around the riser interface.

In particular examples, the riser interface comprises 16 attachment locations. However, it will be recognised that the riser interface may comprise fewer or more attachment locations, as required by the operator.

Beneficially, the attachment locations permit the tether arrangement to be adapted. For example, the attachment locations permit the position and/or angle of the tethers to be selected.

In particular examples, the attachment locations take the form of bores extending through the riser interface.

Part of the coupling arrangement for coupling the riser interface to the tether arrangement may be provided on, or form part of, the tether arrangement.

The tethers may comprise a coupler for coupling to the riser interface. The coupler may couple to one or more of the attachment locations on the riser interface.

The coupler may comprise a swivel.

The coupler may comprise a chain.

The support system may comprise a connector arrangement for connecting the tether arrangement to the offshore platform, more particularly but not exclusively to the cantilever of the offshore platform.

The connector arrangement may comprise a swivel connector or the like.

In particular examples, the support system may be mounted on and/or carried by the cantilever.

Beneficially, supporting and/or carrying the support system on the cantilever permits the horizontal support system to move with the cantilever and may for example permit the support system to be located at a position beyond the reach of the Texas deck, increasing the flexibility and operational reach of the support system.

However, other means for supporting the support system may be provided.

According to a second aspect, there is provided a bottom-supported offshore platform, comprising:

a support system for providing horizontal support to a riser extending downward from a cantilever along the well centre and into a body of water, the support system comprising a riser interface defining a vertical opening for receiving the riser and a tether arrangement for tethering the riser interface to a platform, wherein the support system is configured to permit asymmetric placement of the riser relative to the cantilever.

In particular examples, the offshore platform comprises a hull and one or more legs extendable from the hull downward towards the seabed of a body of water so as to elevate the hull above a surface of the body of water and a cantilever extendable over a side of the hull, the cantilever defining the well centre along which well operations may be performed, the cantilever being adjustable to provide horizontal adjustment of the position of the well centre.

In particular examples, the support system may be configured for use with an access deck of the platform. The access deck may comprise a Texas deck, that is a deck suspended from the cantilever below the rotary table and rig floor where operators can access the blow out preventer (BOP) stack.

However, in other examples the support system may be configured for use with other access arrangements.

The platform may comprise the access deck.

The support system may be disposed at a location distal to the access deck e.g. the Texas deck. For example, the support system may be interposed between the Texas deck and the BOP stack. More particularly but not exclusively the support system may be interposed between the drill floor and the BOP stack.

According to a third aspect, there is provided an offshore system for supporting a riser comprising the support system of the first aspect.

According to a fourth aspect, there is provided a method for supporting a riser using the support system of the first aspect.

According to a fifth aspect, there is provided a method of accessing a well installation using the support system of the first aspect.

The method may comprise an intervention operation.

It should be understood that the features defined above or described below may be utilised, either alone or in combination with any other defined or described feature.

DETAILED DESCRIPTION OF THE DRAWINGS

Figure 1:
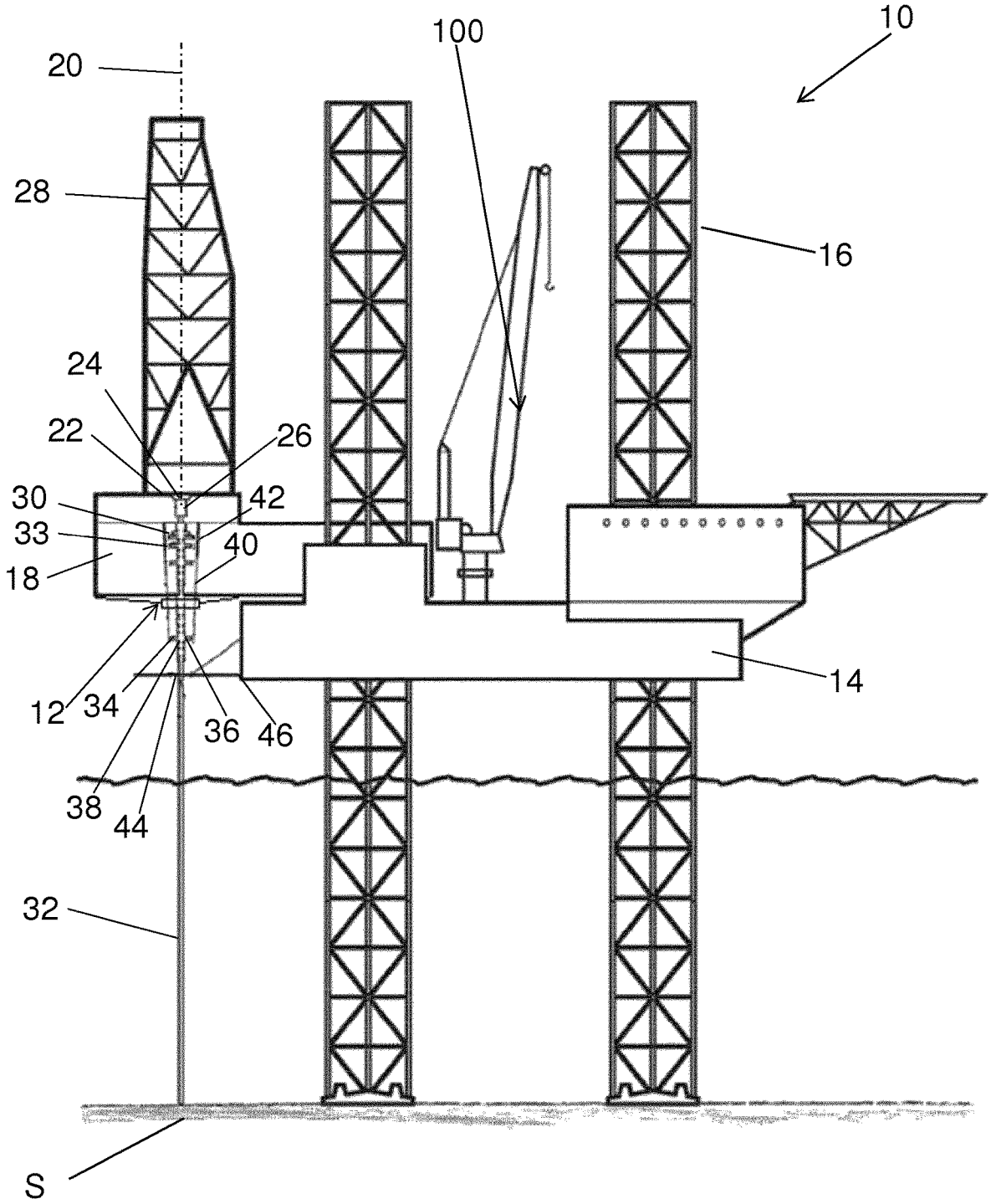
FIG. 1 shows a diagrammatic illustration of a bottom-supported offshore platform according to an example of the present disclosure.
Figure 2:
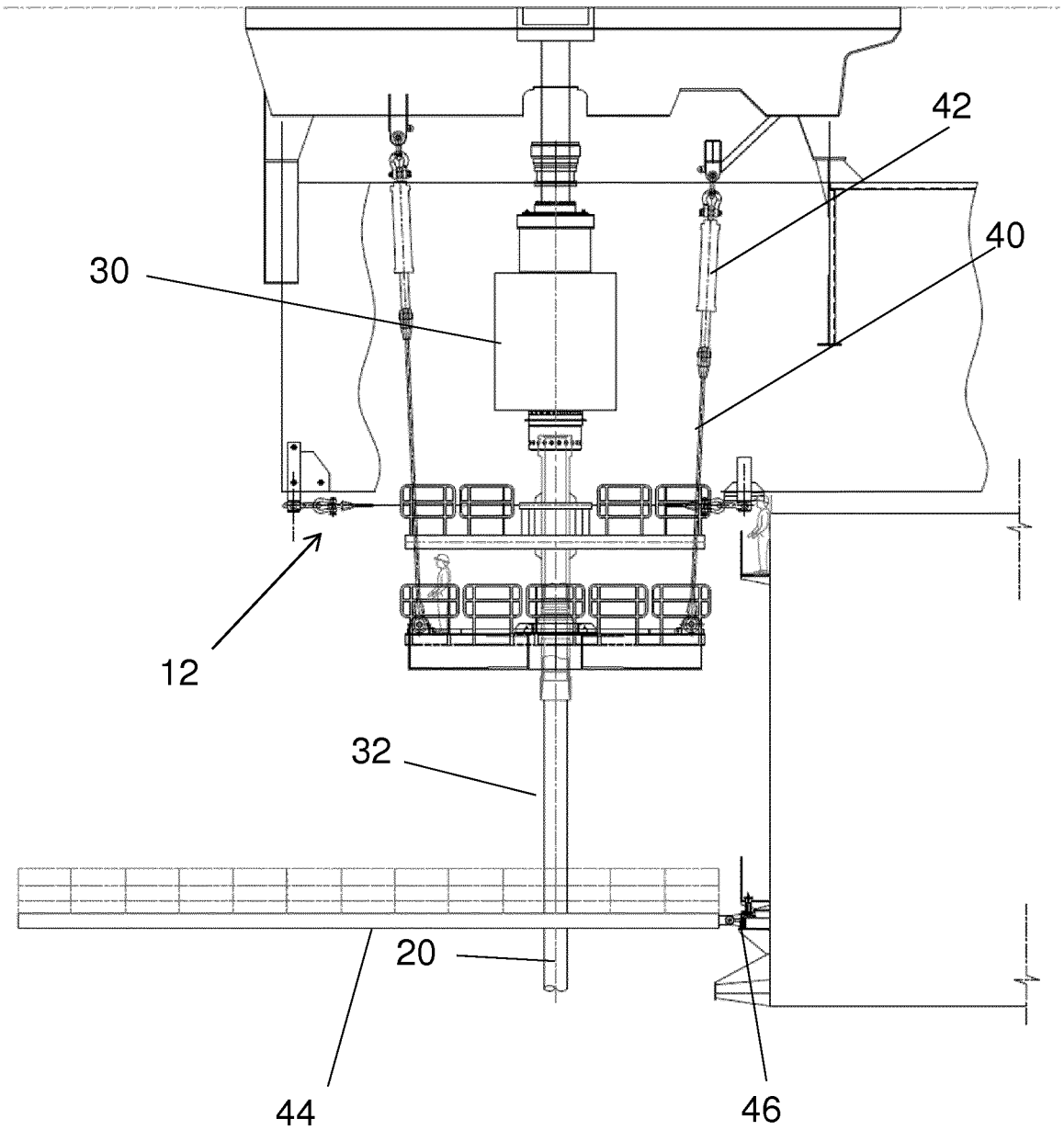
FIG. 2 shows an enlarged view of the offshore platform shown in FIG. 1.

Referring first to FIGS. 1 and 2 of the accompanying drawings, there is shown an offshore platform 10, which in the illustrated example takes the form of a bottom-supported or "jack up" rig.

According to examples of the present disclosure, the offshore platform 10 is operable to perform intervention operations and includes a horizontal support system 12, as will be described further below.

As shown in FIG. 1, the offshore platform 10 is floatable, having a hull 14, a number of legs 16 which extend through the hull 14 and a cantilever 18 which allows intervention equipment to be translated ("skidded") so that the position of a well centre 20 can be moved horizontally outside the periphery of the hull 14. The cantilever 18 comprises a drill floor 22, a rotary table 24 disposed on the drill floor 22 defining the position of the well centre 20.

A diverter system 26 is installed below the rotary table 24. The offshore platform 10 further comprises a drilling support structure 28, which in the illustrated embodiment takes the form of a mast or derrick. The drilling support structure 28 extends upwardly from the cantilever 18 and supports a hoisting system (not shown). The hoisting system comprises a hook or similar device from which a string of tubulars may be suspended and lowered and raised through the well centre 20. The hoisting system may comprise a top drive. In general, such a cantilever may be said to be a drilling cantilever i.e. defining a well centre of a drilling platform and supporting a drilling system (i.e. a drilling support structure, such as a derrick or mast, and drilling equipment, such as a hoisting system and top a drive). Such cantilevers are well-known in the art and extensively used on jack-up rigs in various configurations. Besides being extendible the cantilever may be able to transverse sideways (a so-called) XY cantilever. In other configurations, the cantilever is extendible while transverse movement of the well centre relative to the hull and the cantilever is performed by translating the drilling system (drill floor, support structure, drill floor) relative to the cantilever. The present invention may be of particular value for such cantilevers as the tensioning system for a riser is typically required to be fixed to the cantilever below the drill floor. Accordingly by translating the drilling system, the well centre may be off the centre axis of the cantilever leading to a need for asymmetrical support so that with support system attached symmetrically in the cantilever.

A Blow Out Preventer stack ("BOP stack") 30 is installed and a riser 32 extends downwards towards the seabed S. The BOP stack 30 comprises multiple BOP rams 33 and/or other components arranged in a vertical tier. Furthermore, additional equipment, such as pressure control equipment, may be installed above and/or below the BOP stack 30 and below the rotary table 24.

A tension frame 34, which in the illustrated example takes the form of a tension or similar support member, is provided for vertically supporting the weight of the riser 32. The tension frame 34 comprises or defines a through passage 36 through which the riser 32 extends. In the illustrated example, a guide member 38 is also provided to guide the riser 32. In use, the weight of the riser 32 is supported by the tension frame 34 which is itself suspended below the cantilever 18 by tension wires 40 and cylinders 42 extending from the cantilever 18 downwards to the tension frame 34.

The offshore platform 10 further comprises an access deck 44, which in the illustrated example takes the form of a Texas deck. The access deck 44 is arranged below the BOP stack 30 and, in use, the access deck 44 provides access to the BOP stack 30. In the illustrated example, the access deck 44 is attached to the hull 14 by hinges 46. In use, the access deck 44 extends horizontally outwards and away from the hull 14, but may be lifted into an upright position where required.

Figure 3:
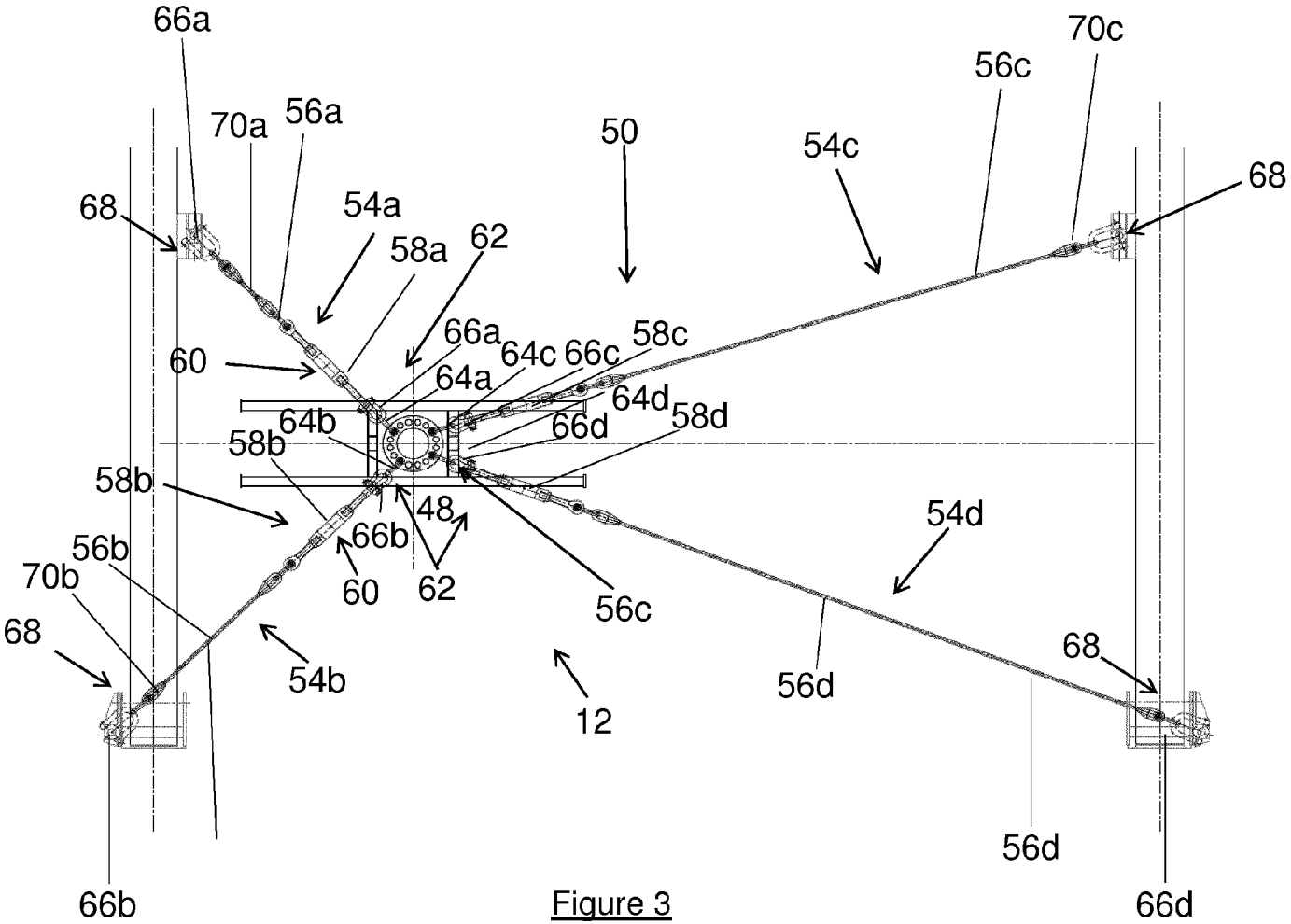
FIG. 3 shows a support system according to an example of the present disclosure.
Figure 4:
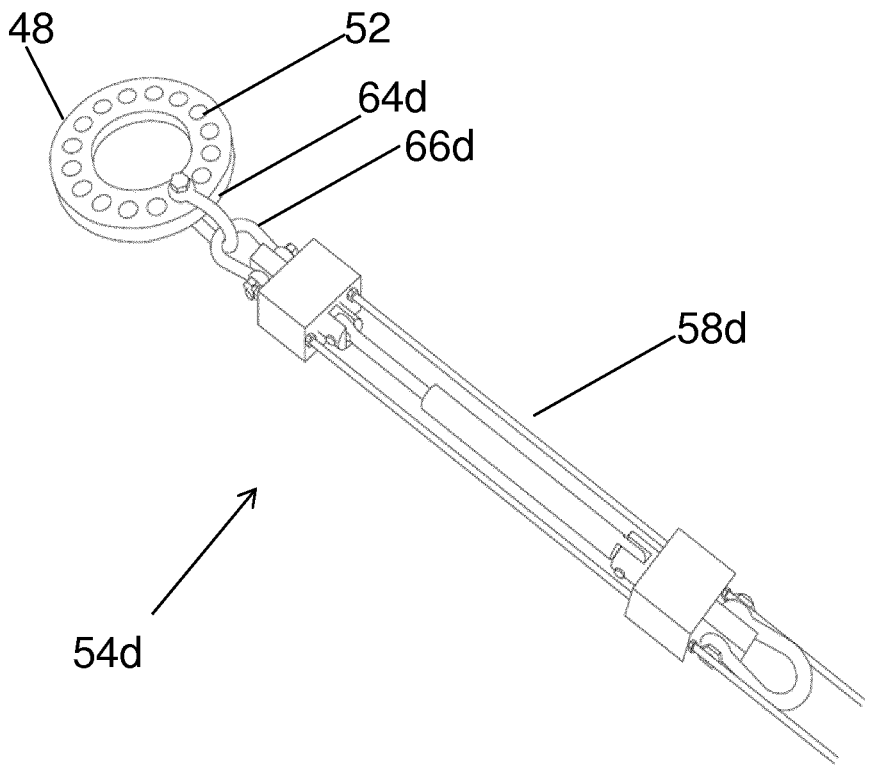
FIG. 4 shows an enlarged view of part of the support system shown in FIG. 3.

The support system 12 is shown in more detail in FIGS. 3 and 4 of the accompanying drawings. As shown, the support system 12 comprises a riser interface 48 and a tether arrangement 50.

Beneficially, the support system 12 provides for symmetric and asymmetric placement of the riser interface 48—and the riser 32—relative to the cantilever 18. The riser interface 48 may thus be adjusted to any position on an X-Y plane. Moreover, the support system 12 facilitates interventions operations to be carried out with reduced manual interface or with no manual interface, with corresponding reduced risk to personnel operating in the environment.

In the illustrated embodiment, the riser interface 48 takes the form of a ring member. In use, the riser interface 48 surrounds the riser 32 and has a number of bores 52 defining attachment locations for the tether arrangement 50. In the illustrated example, sixteen bores 52 are provided. However, it will be recognised that any suitable number of bore 52 may be provided.

The tether arrangement 50 is adjustable to adjust the horizontal position of the riser interface 48.

The tether arrangement 50 includes a number of tethers 54*a*, 54*b*, 54*c* and 54*d*. Tether 54*a* defines a port side fore tether. Tether 54*b* defines a port side aft tether. Tether 54*c* defines a starboard side fore tether. Tether 54*d* defines a starboard side aft tether. It will be recognised that the tether arrangement 50 may comprise more or fewer tethers.

As shown in FIG. 3, which shows a plan view of the support system 12, each of the tethers 54*a*, 54*b*, 54*c*, 54*d* comprises a first, cable, portion 56*a*, 56*b*, 56*c*, 56*d*. In the illustrated example, the first portion 56*a*, 56*b*, 56*c*, 56*d* of each of the tethers 54*a*, 54*b*, 54*c*, 54*d* comprises wire rope, in particular but not exclusively steel wire rope.

Each of the tethers 54*a*, 54*b*, 54*c*, 54*d* comprises an actuator 58*a*, 58*b*, 58*c*, 58*d*. The actuators 58*a*, 58*b*, 58*c*, 58*d* are coupled between the respective first, cable, portions 56*a*, 56*b*, 56*c*, 56*d* and the riser interface 48. The actuators 58*a*, 58*b*, 58*c*, 58*d* together form an actuator arrangement 60 of the support system 12. In use, the actuators 58*a*, 58*b*, 58*c*, 58*d* are configured—by adjustment in the length/stroke—to adjust the horizontal position of, provide horizontal support to, and/or apply tensile force to, the riser interface 48. In the illustrated example, the actuators 58*a*, 58*b*, 58*c*, 58*d* take the form of hydraulic linear actuators. However, it will be understood that a mechanical arrangement, e.g. a turnbuckle arrangement or the like, may alternatively or additionally be provided.

A coupling arrangement 62 is provided for coupling the tethers 54*a*, 54*b*, 54*c*, 54*d* to the riser interface 48. In the illustrated example, the coupling arrangement 62 takes the form of chain links 64*a*, 64*b*, 64*c*, 64*d* which engage the bores 52 and pad eyes 66*a*, 66*b*, 66*c*, 66*d* connected to, or formed on, the actuators 58*a*, 58*b*, 58*c*, 58*d*.

A connector arrangement 68 is provided for coupling the tethers 54*a*, 54*b*, 54*c*, 54*d* to the cantilever 18. In the illustrated example, the connector arrangement 68 takes the form of swivel connectors e.g. in the form of tie rods 70.

As shown, the support system 12 is configured so that each of the tethers 54*a*, 54*b*, 54*c*, 54*d* is arranged at a given angle relative to the riser interface 48. In use, each of the tethers 54*a*, 54*b*, 54*c*, 54*d* is arranged at a given angle relative to the riser interface 48 so as to permit the position of the riser interface 48 to be adjusted and/or to vary the tensile force applied to the riser interface 48.

In the illustrated example, the tether arrangement 50 is lockable. Beneficially, the ability to lock the actuator arrangement 60 provides redundancy in the support system 12, providing two possible mechanisms for adjustment.

In the illustrated example, the tie rods 70 are lockable. In other examples, the actuators 58*a*, 58*b*, 58*c*, 58*d* may be lockable.

In use, the tether arrangement 50 may be operable to locate the riser interface 48 at a desired location, the tether arrangement 50 being lockable to maintain the position of the riser interface 48 at the desired location. Beneficially, examples of the present disclosure permit the riser interface 48 to be located and locked in position before the riser 32 is in place, such that the actuator arrangement is not exposed to loads imparted by the riser 32. Moreover, examples of the present disclosure also provide safety benefits for personnel, since manual operations may be reduced or eliminated.

The support system 12 is configured to apply a tensile force to the riser interface 48 using the tethers 54*a*, 54*b*, 54*c*, 54*d* of the tether arrangement 50.

The ability to apply tensile force and to lock the tether arrangement 50 may thus be configured to pre-tension the riser interface 48.

Beneficially, in examples of the present disclosure the actuators 58*a*, 58*b*, 58*c*, 58*d* can be smaller than otherwise necessary, as they are only used to position and tension the riser interface 48, and not to position the riser 32 itself.

Thereafter, the support system 12 is configured to passively provide horizontal support to the riser interface 48. For example, once installed the support system 12 passively supports the riser interface 48—and in use the riser 32. Beneficially, the support system 12 does not require complex ongoing and active control systems during operations.

Beneficially, supporting and/or carrying the support system 12 on the cantilever 18 permits the horizontal support system 12 to move with the cantilever 18 and may for example permit the support system 12 to be located at a position beyond the reach of the access deck 44 increasing the flexibility and operational reach of the support system 12.

The system and method of the present disclosure will now be described with reference also to FIGS. 5A to 7U of the accompanying drawings.

Prior to arrival on location, a number of modifications have been made to the platform 10 to facilitate operations.

The access deck 44, which in the illustrated embodiment takes the form of a Texas deck, has been reinforced.

Figure 5A:
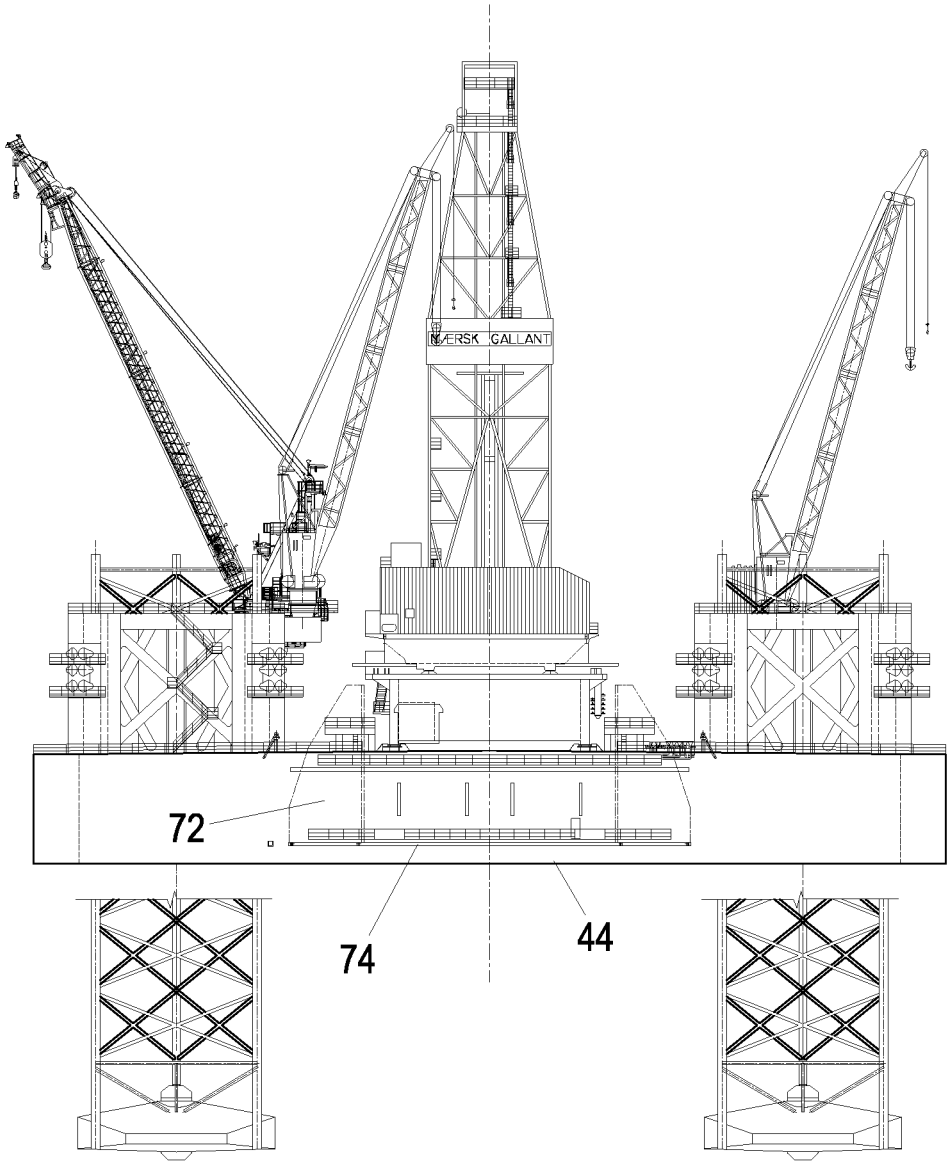
FIGS. 5A to 5I illustrate a system and method for supporting a riser in accordance with an example of the present disclosure, prior to arrival at the operational location.
Figure 5B:
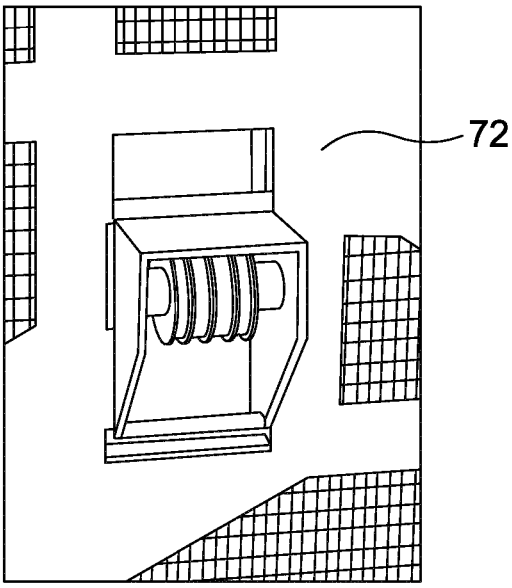

The wires from port side flap 72 of the access deck 44 have been removed (as shown in FIG. 5B).

The pins and bushing have been replaced.

The pad eyes have also been reinforced.

The skidding beams 74 have also been enlarged.

Figure 5C:
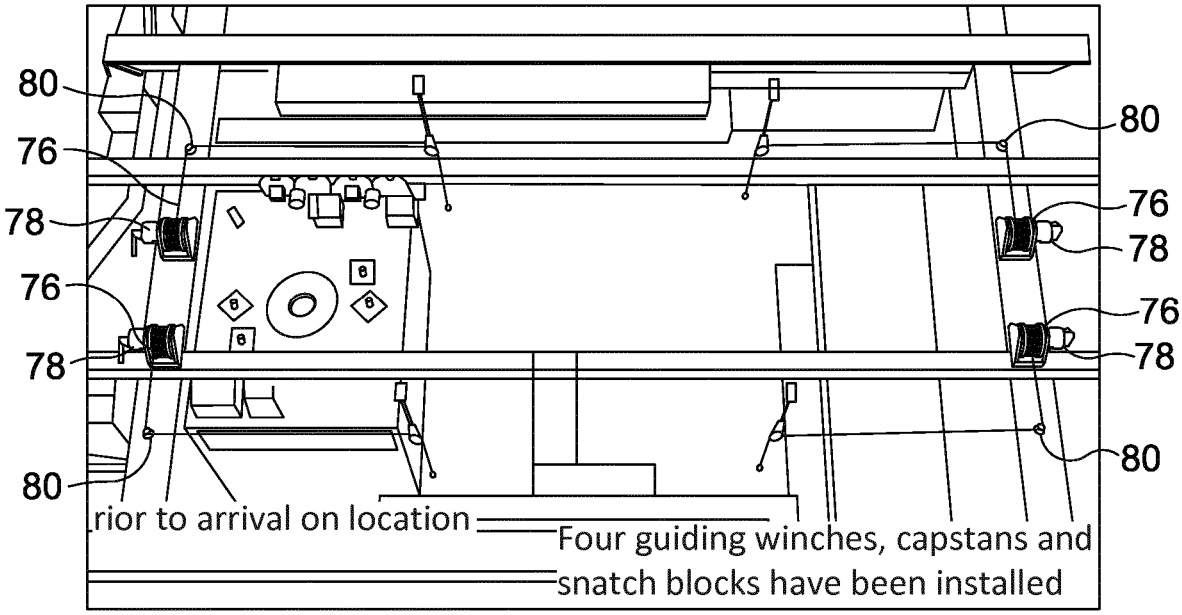

As shown in FIG. 5C, four guiding winches 76, capstans 78 and snatch blocks 80 have been installed.

Figure 5D:
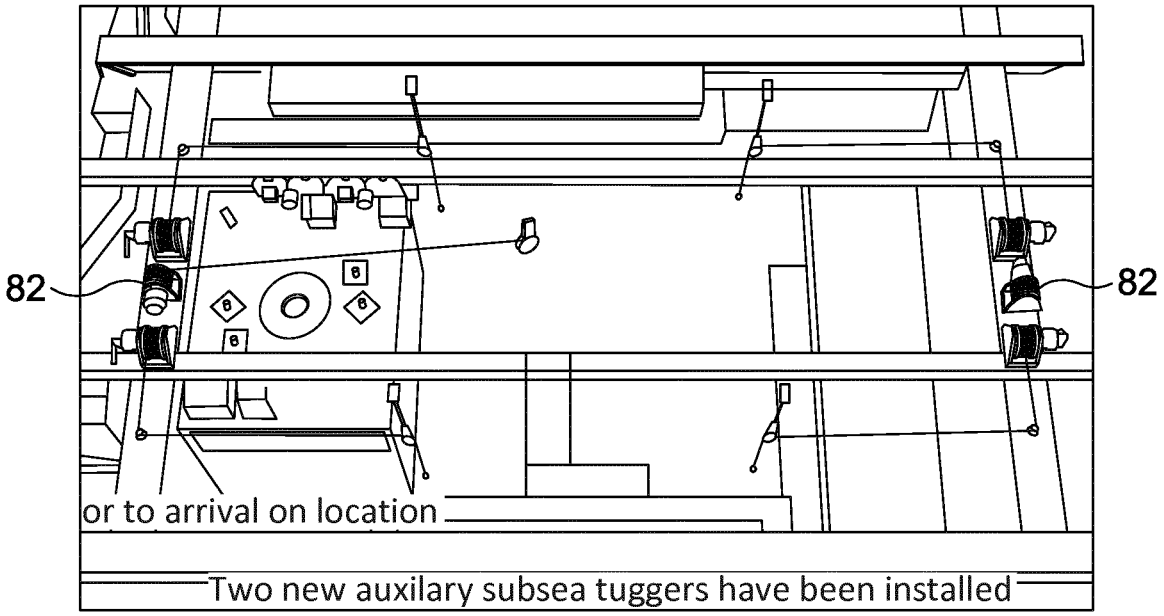

As shown in FIG. 5D, two auxiliary subsea tuggers 82 have also been installed.

Figure 5E:
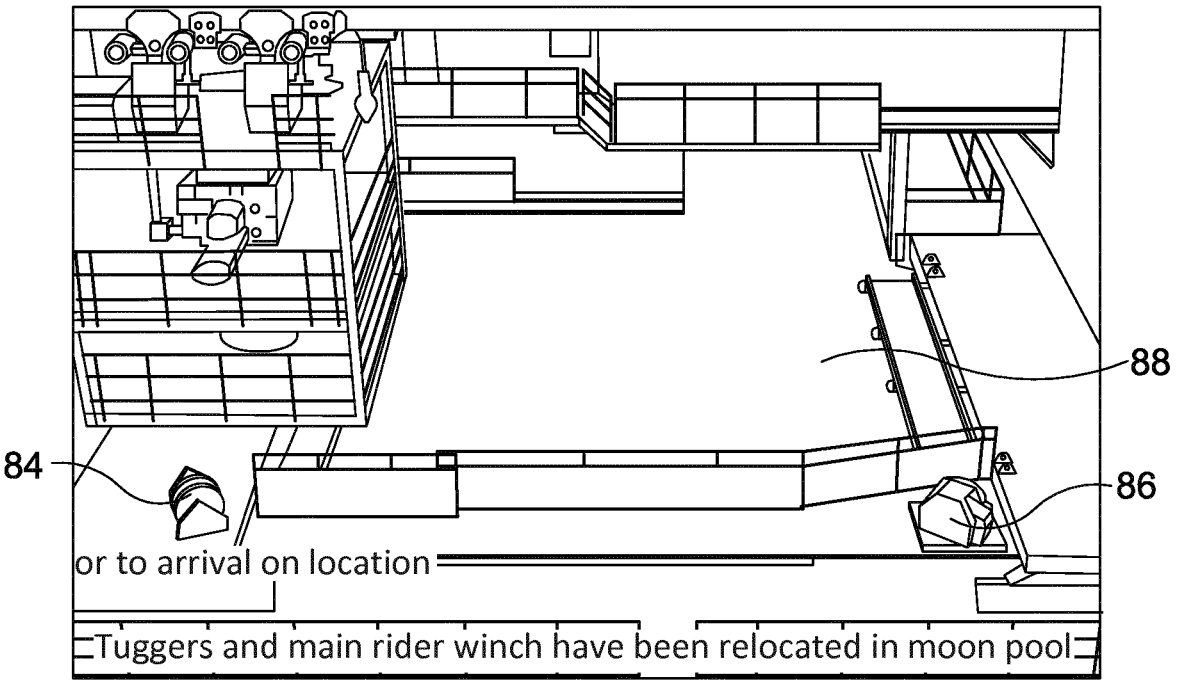

Tugger 84 and man rider winch 86 have been relocated in moon pool 88 (as shown in FIG. 5E).

Figure 5F:
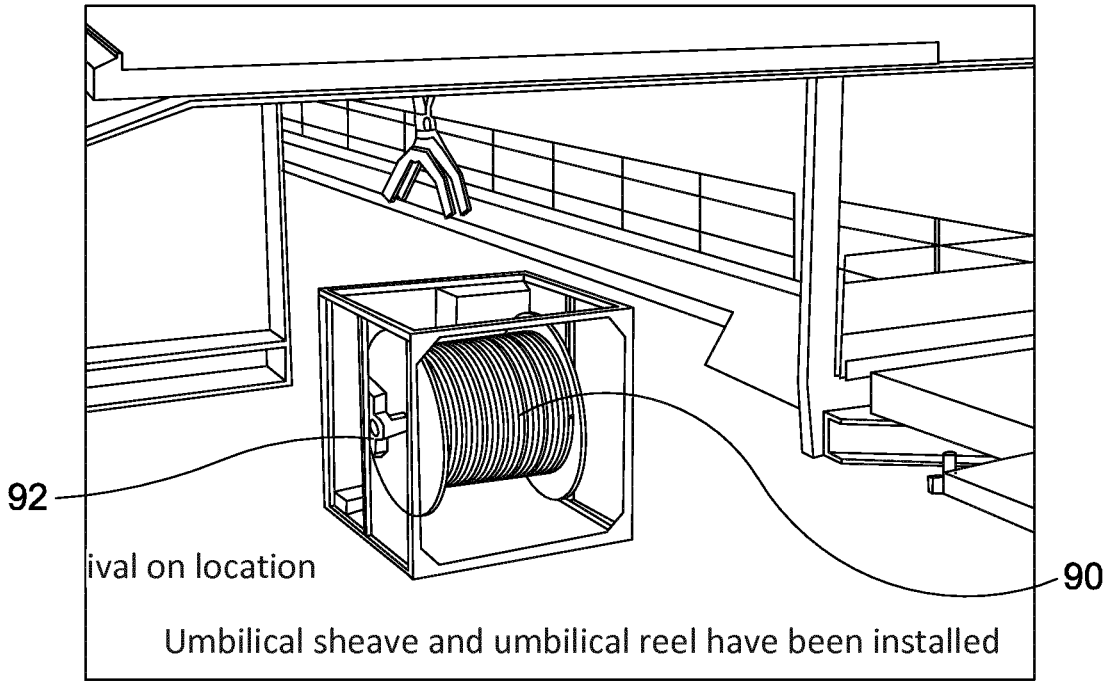

As shown in FIG. 5F, an umbilical 90 and umbilical reel 92 have been installed.

Figure 5G:
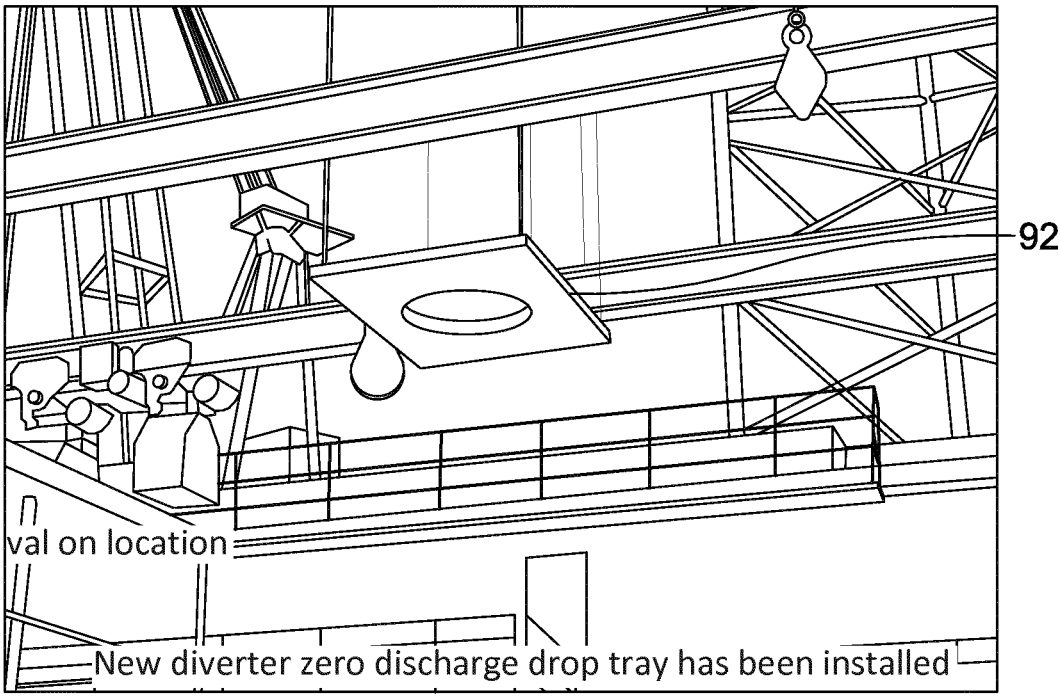

As shown in FIG. 5G, a diverter zero discharge drop tray 94 has also been installed.

Figure 5H:
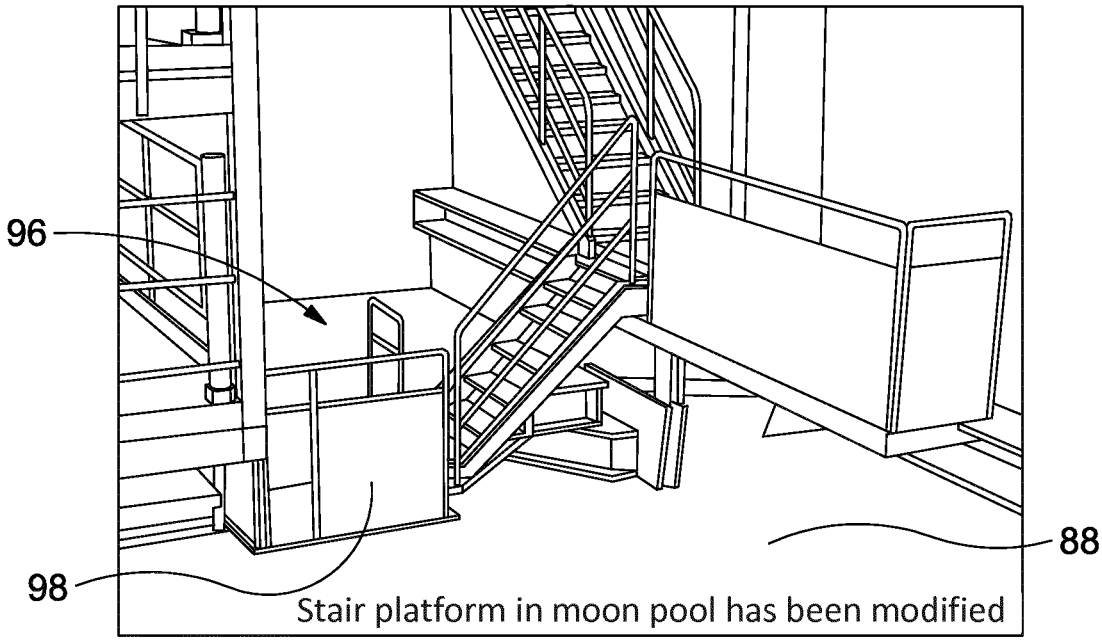
Figure 5I:
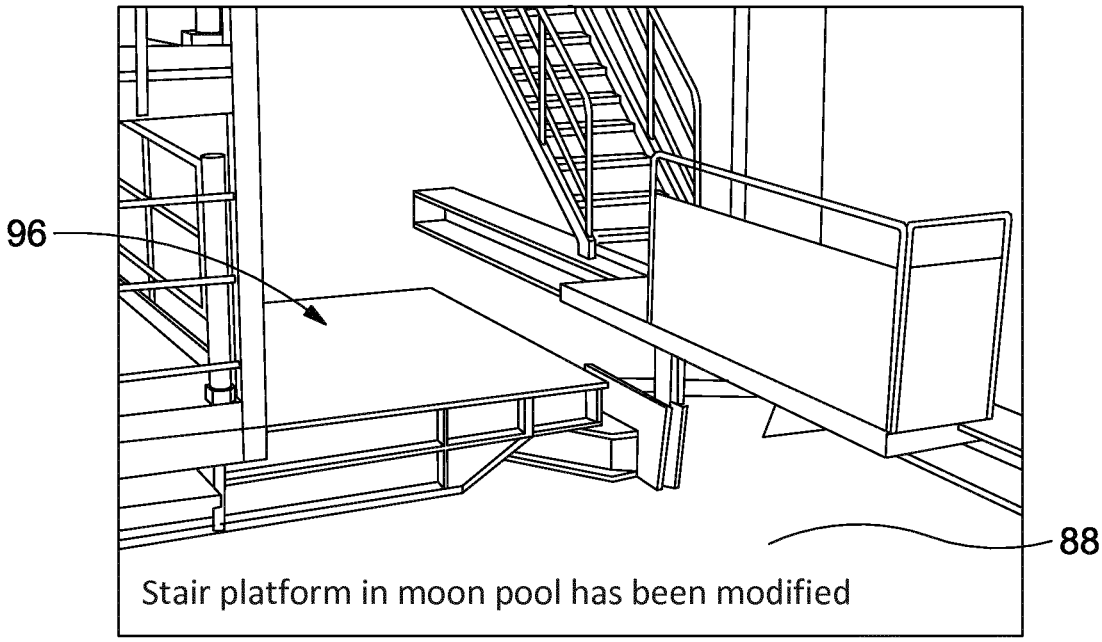

As shown in FIGS. 5H and 5I, the stair platform 96 in the moon pool 88 has been modified, a lower section 98 having been removed.

Figure 6A:
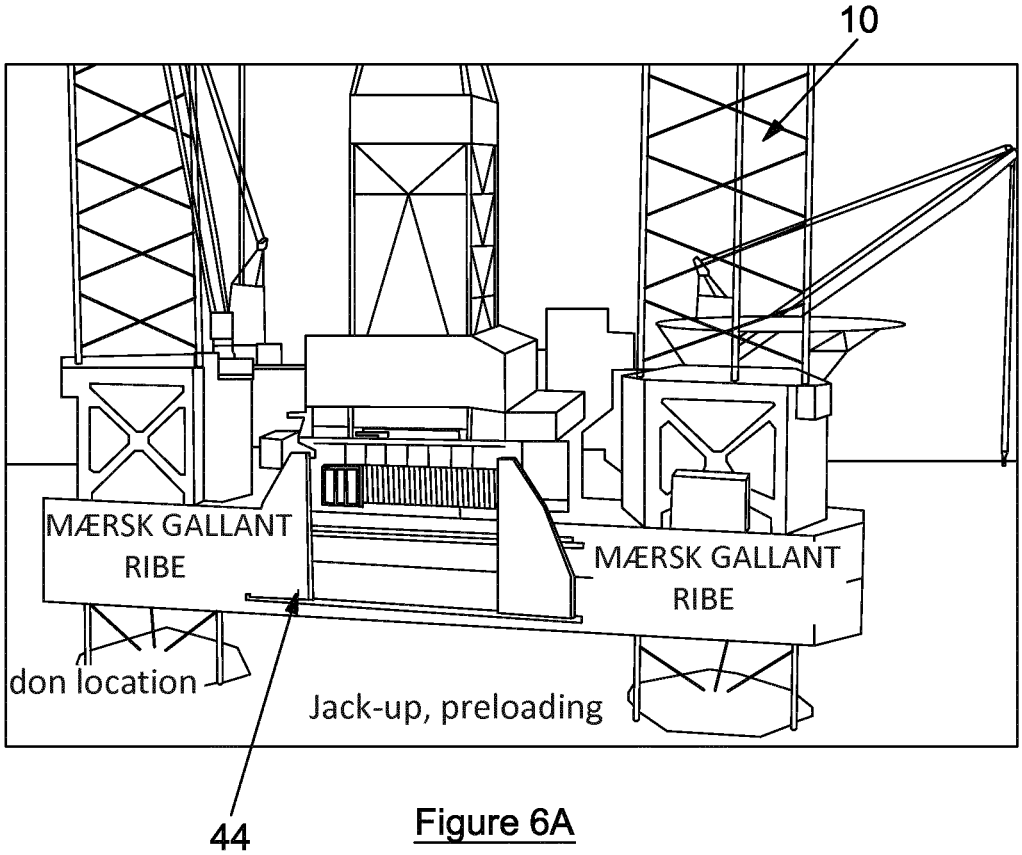
FIGS. 6A to 6AH illustrate the system and method for supporting a riser in accordance with an example of the present disclosure, on location at the operational location.
Figure 6B:
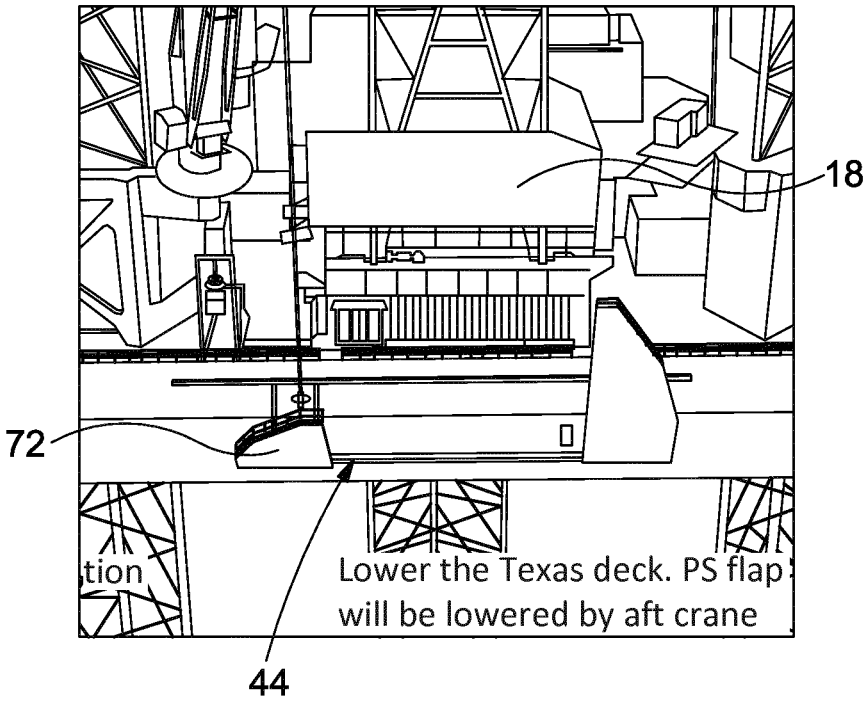
Figure 6C:
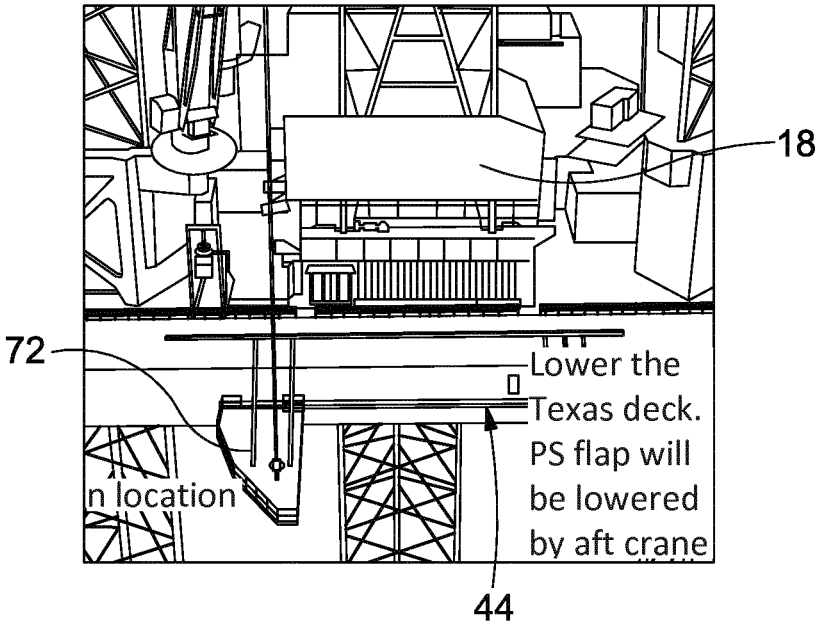
Figure 6D:
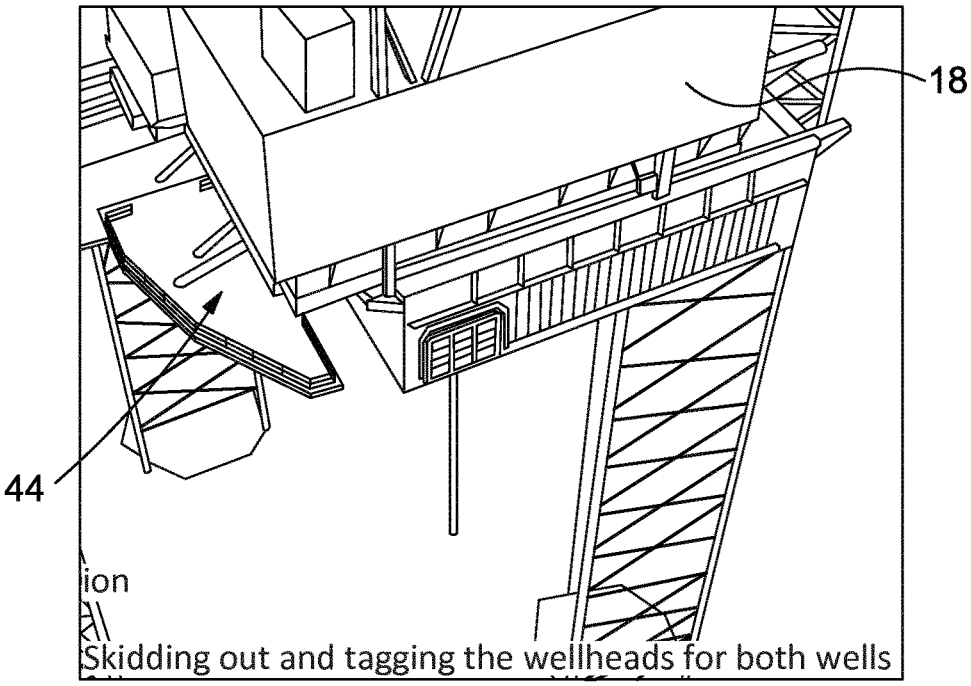
Figure 6E:
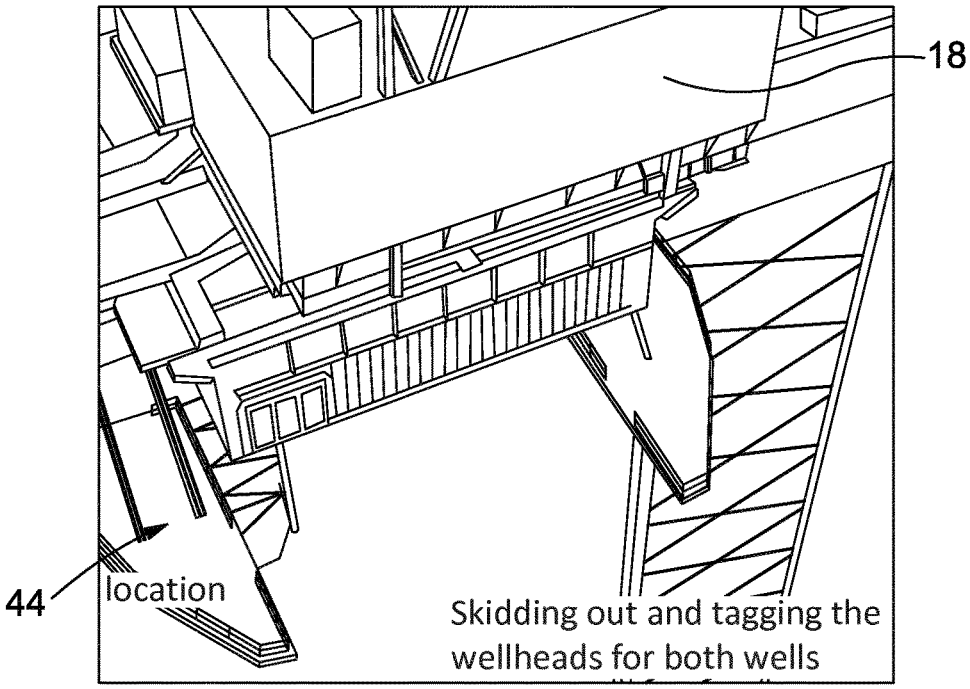
Figure 6F:
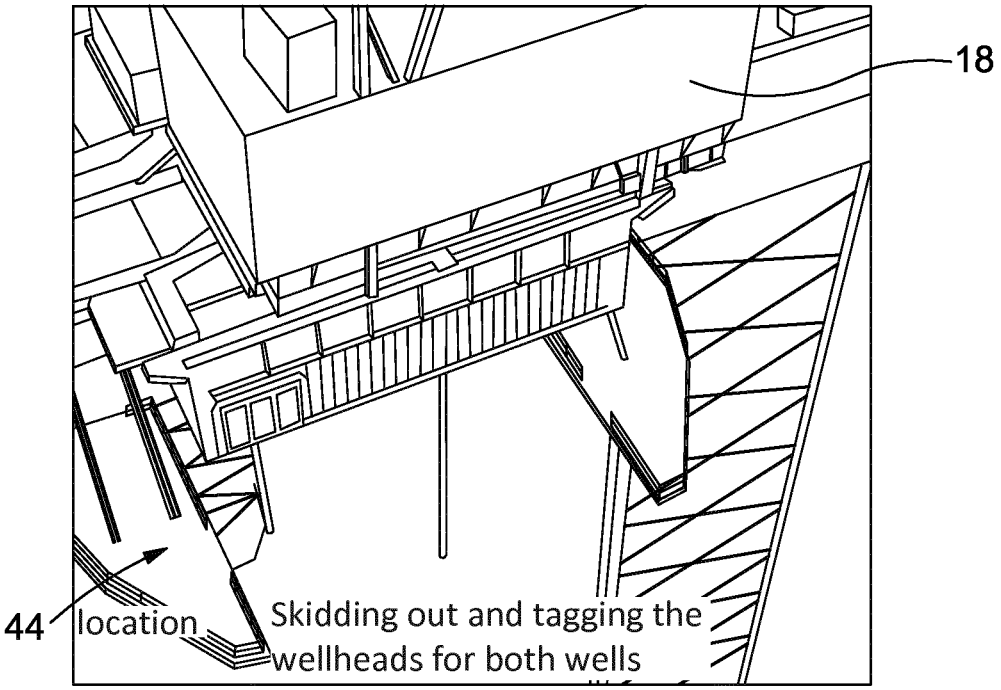
Figure 6G:
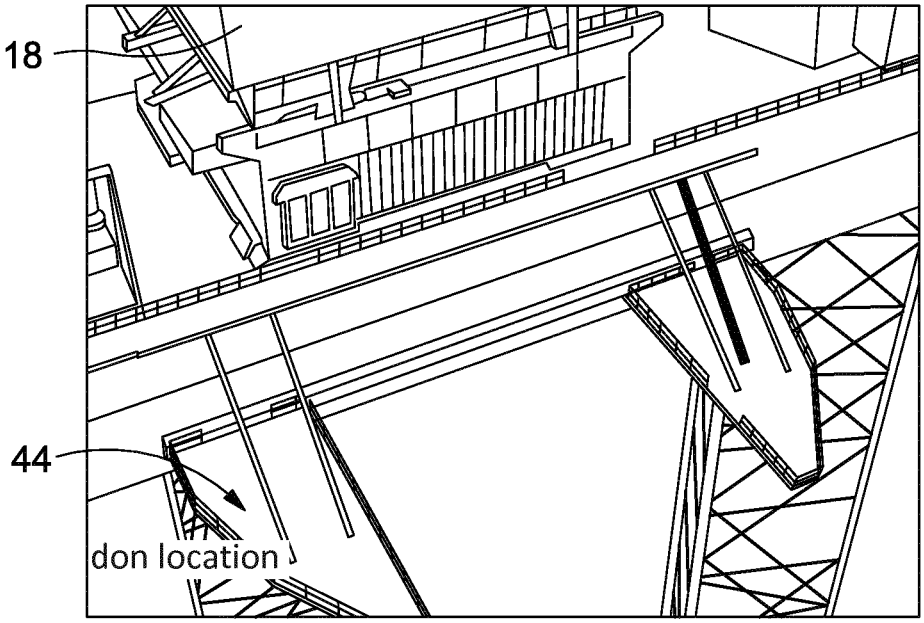
Figure 6H:
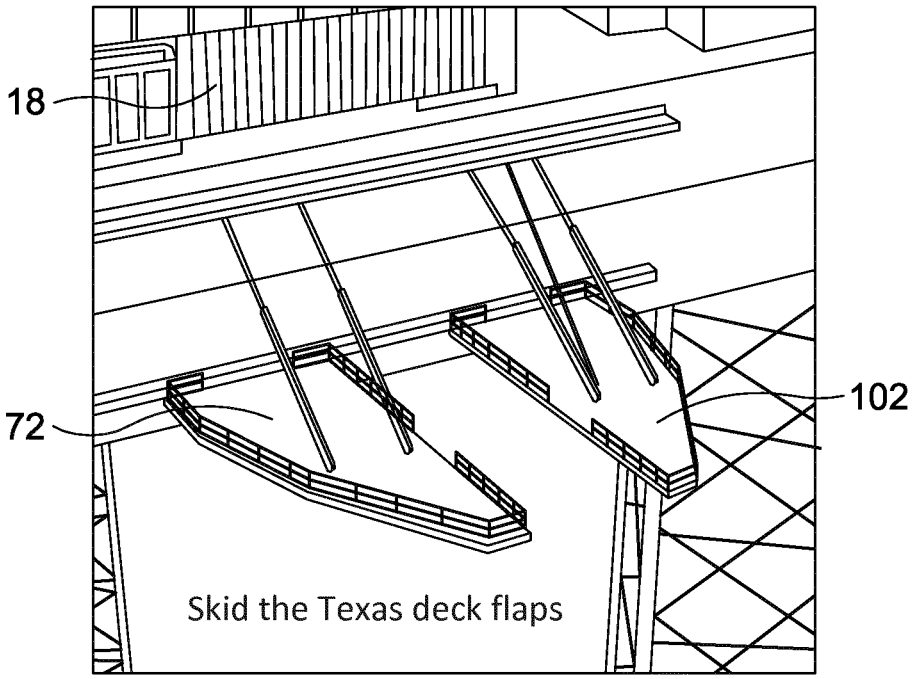
Figure 6I:
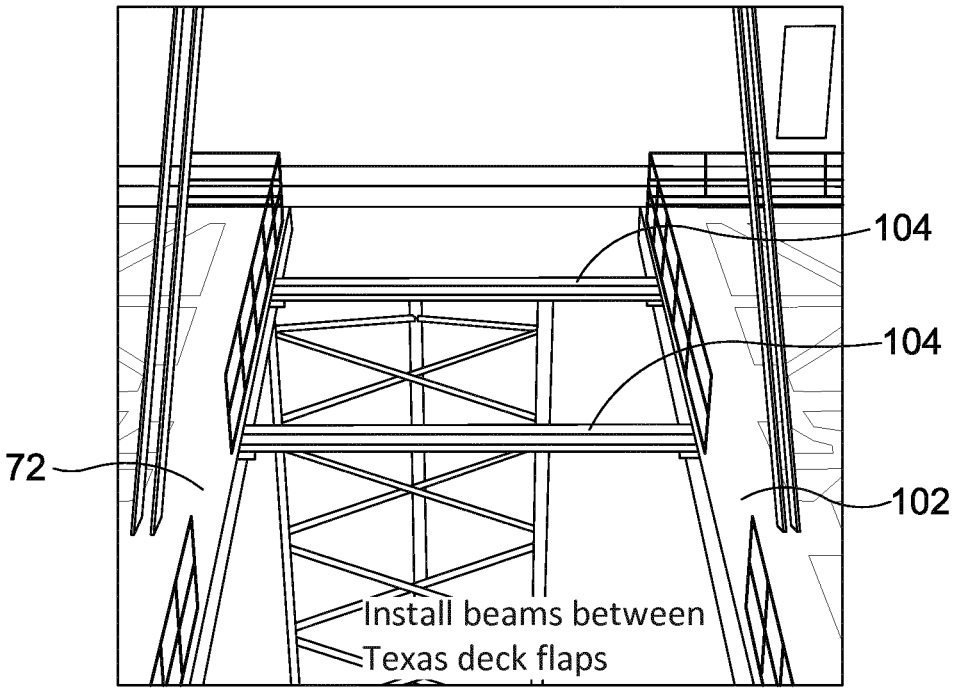
Figure 6J:
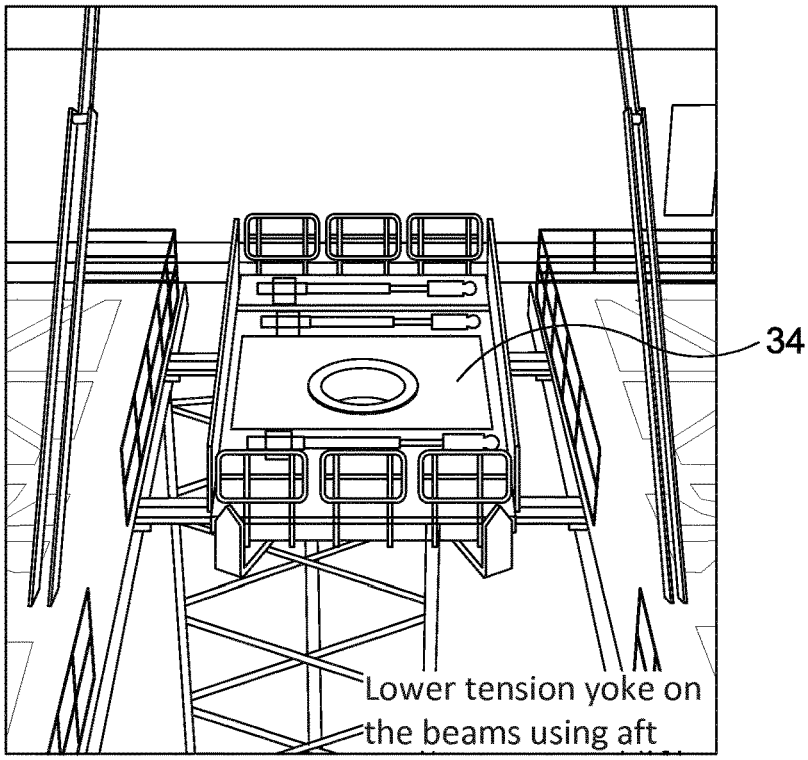
Figure 6K:
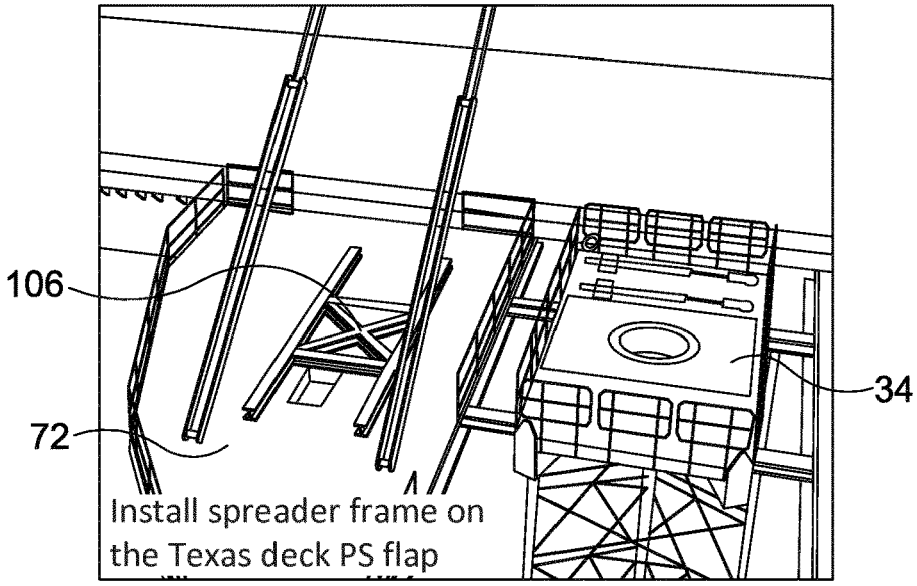
Figure 6L:
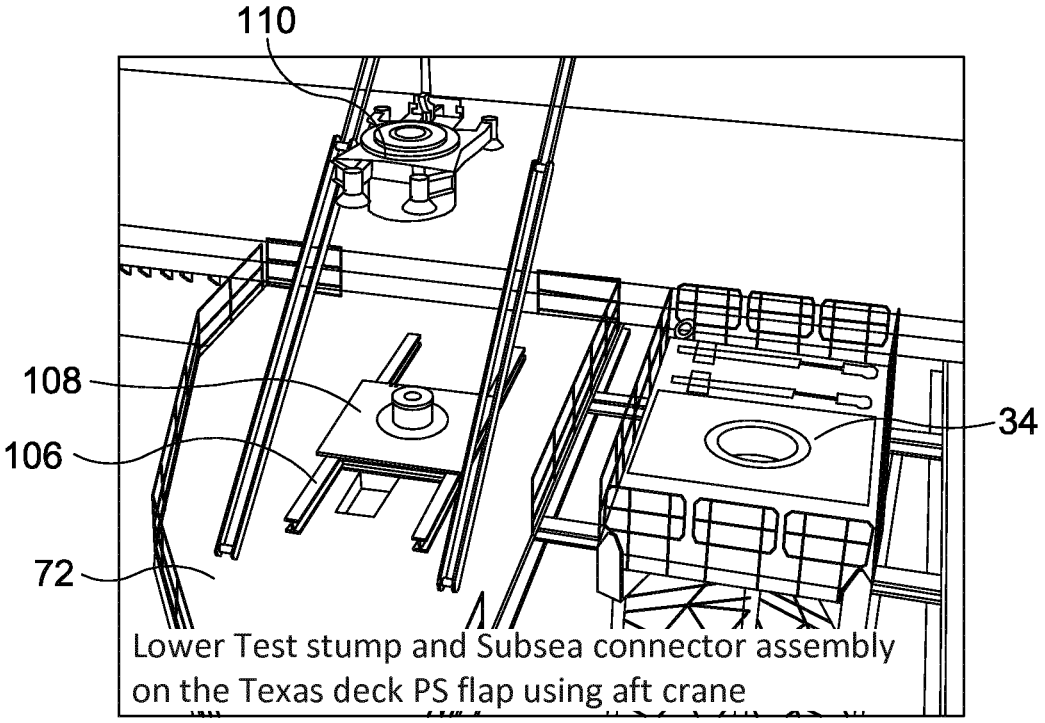
Figure 6M:
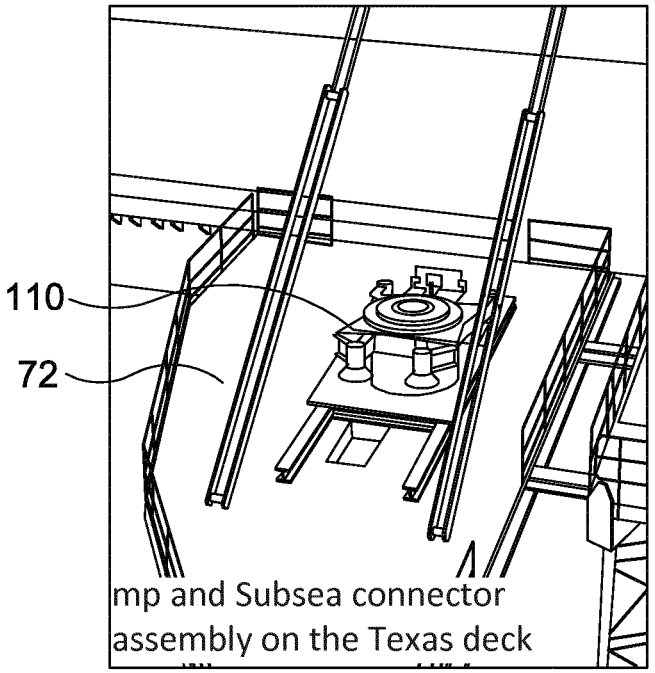

Referring now to FIGS. 6A to 6C of the accompanying drawings, on arrival at the desired location, the offshore platform 10 is jacked-up and the access deck 44 is pivoted from a transport position to a lower, extended, position (as shown in FIG. 6C). As the wires of the port side flap 72 of the access deck 44 have been removed, the port side flap 72 is lowered by aft crane 100 (the aft crane is shown in FIG. 1)

The cantilever 18 is then translated ("skidded") relative to the platform 10 to the first location/well centre and second location/well centre to tag the wells (as illustrated in FIGS. 6D to 6G). By way of example, in the illustrated example in order to tag the first location the cantilever 18 is moved 19 metres in a longitudinal direction relative to the platform 0 and 4.5 metres in a transverse direction relative to the platform 10.

Once skidded to the desired location, the wellheads are tagged, after which the cantilever 18 is returned to its original position on the platform 10.

As shown in FIGS. 6G to 6L, the port side flap 72 and starboard side flaps 102 of the access deck 44 are then translated ("skidded") towards each other, and once in position beams 104 are disposed on the flaps 72, 102. The aft crane 100 is then used to position the tension frame 34 onto the beams 104.

A spreader frame 106 is then disposed on the port side flap 72 of the access deck 44 and a lower test stump 108 and subsea connector assembly 110 is disposed thereon, using the aft crane 100.

Figure 6N:
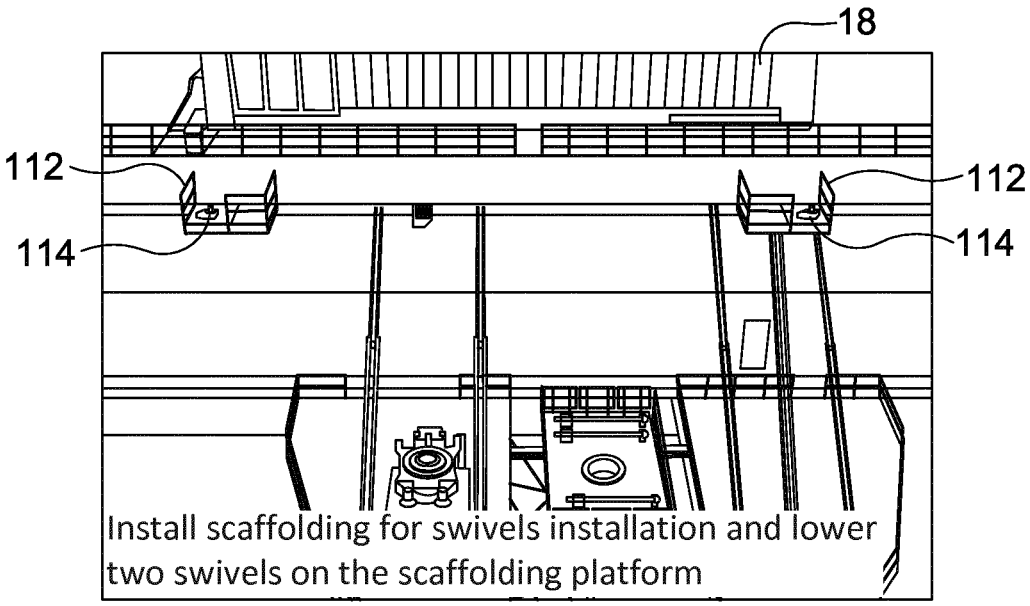
Figure 6O:
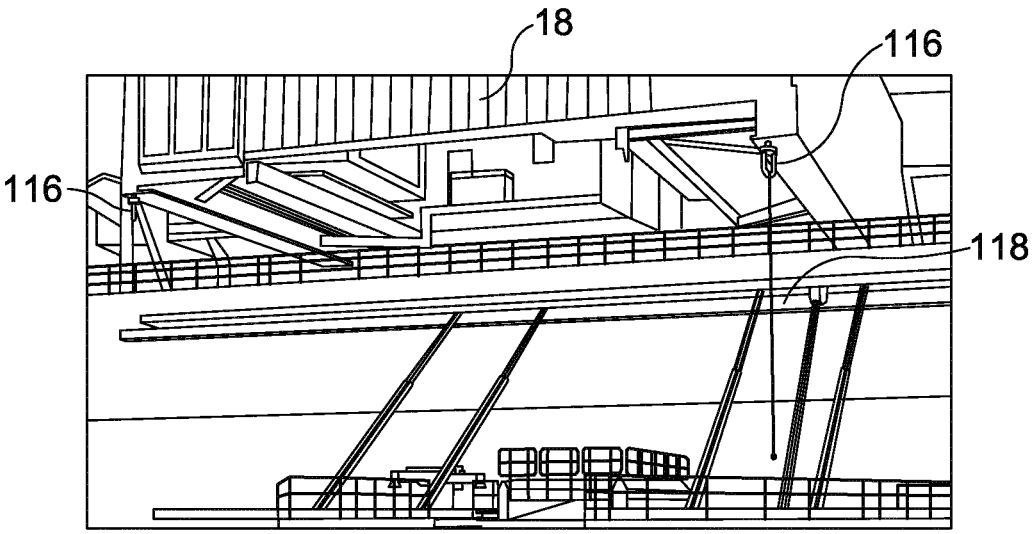

As shown FIGS. 6N and 60, in order to install the horizontal support system 12, scaffolding 112 is installed and two swivels 114 ("lower swivels") are located on the scaffolding 112 while two swivels 116 ("upper swivels") are coupled to an under side of the cantilever 18. Wires 118 are disposed between the upper swivels 116 and lower swivels 114, with one wire 118 disposed between the upper swivel 116 on the port side and the lower swivel 114 on the port side and a wire 118 disposed between the upper swivel 116 on the starboard side and the lower swivel 114 on the starboard side.

Figure 6P:
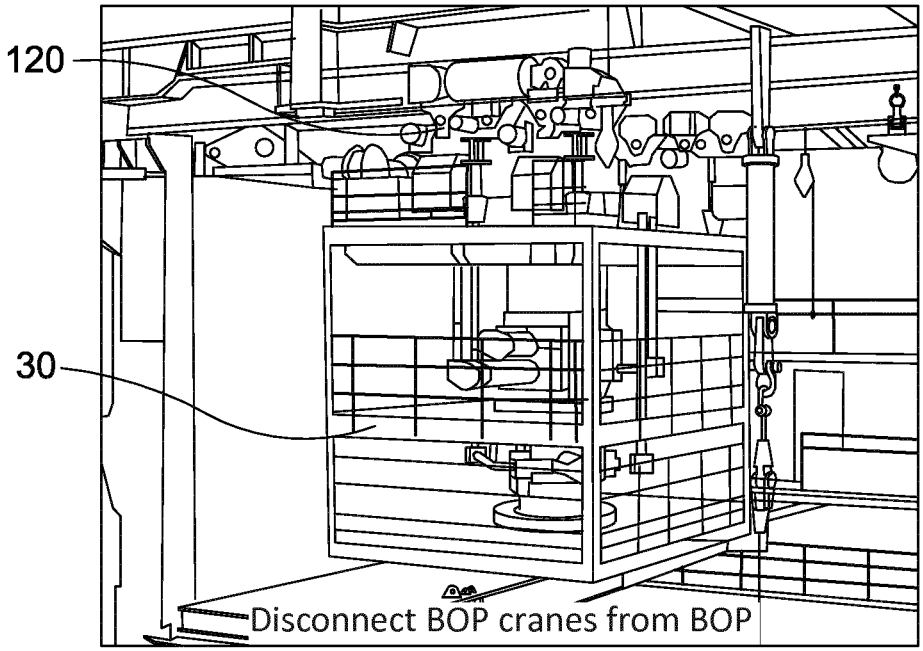
Figure 6Q:
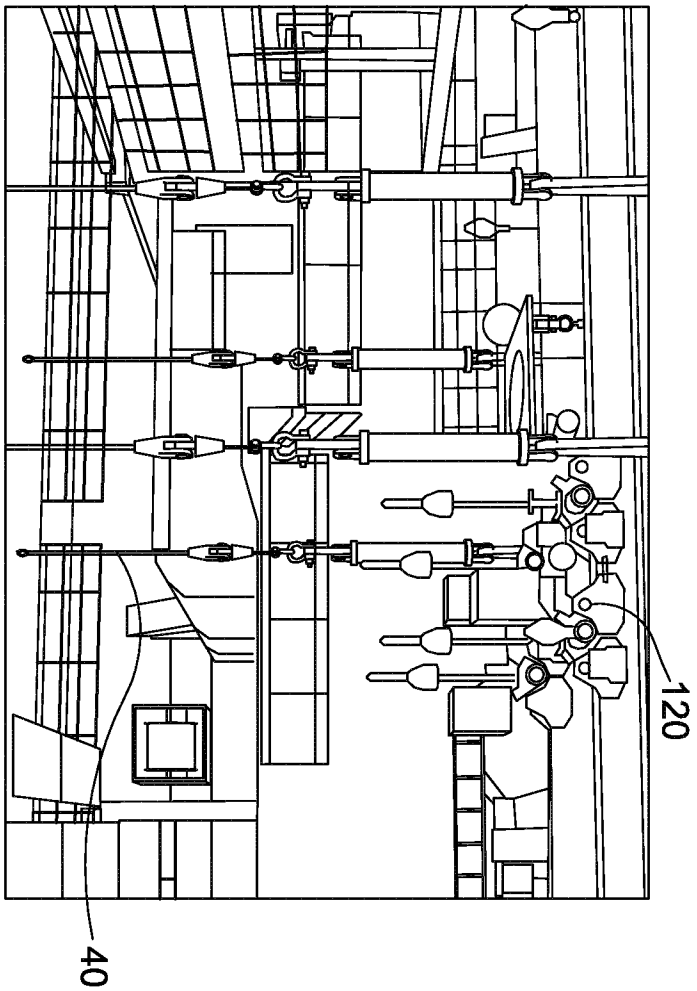
Figure 6R:
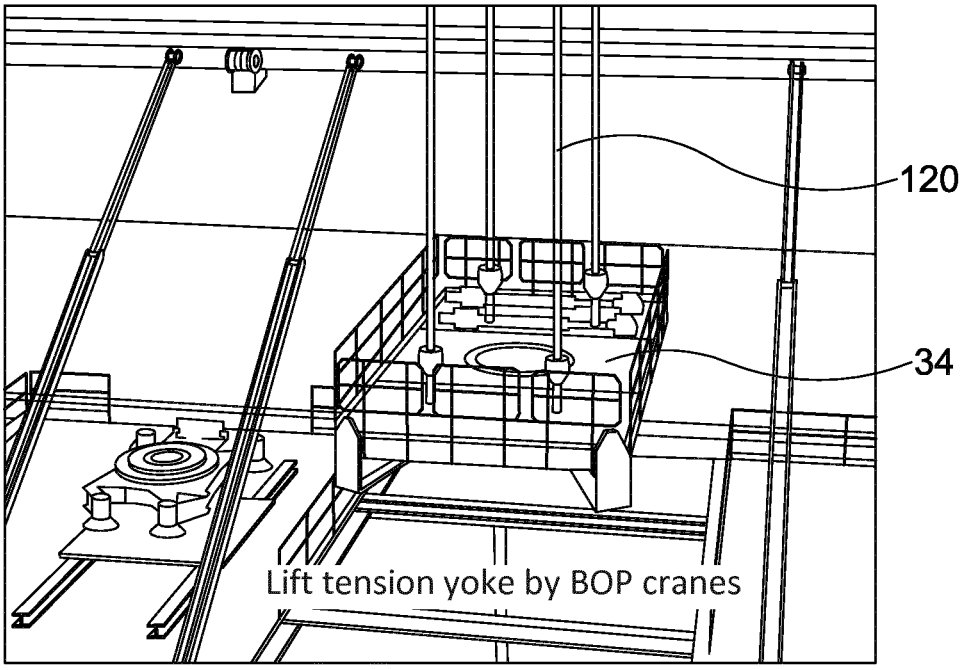
Figure 6S:
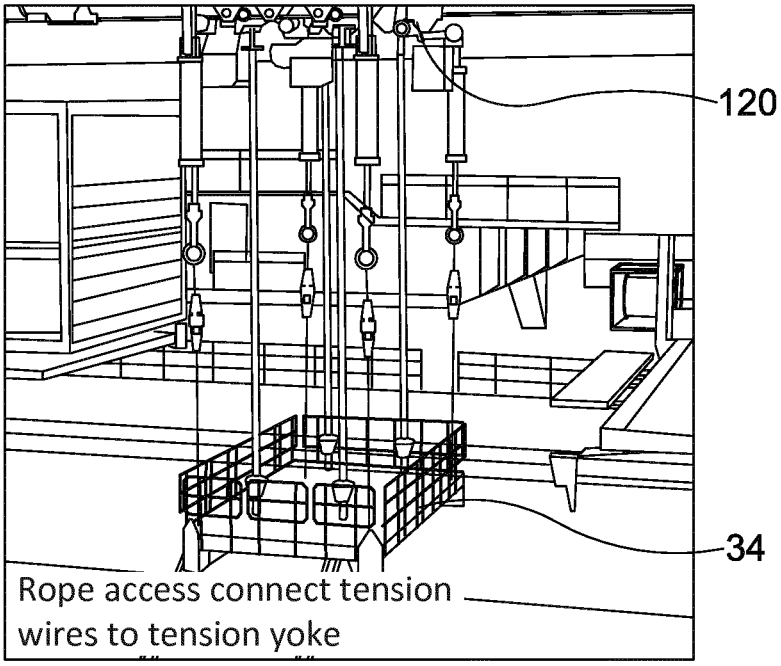
Figure 6T:
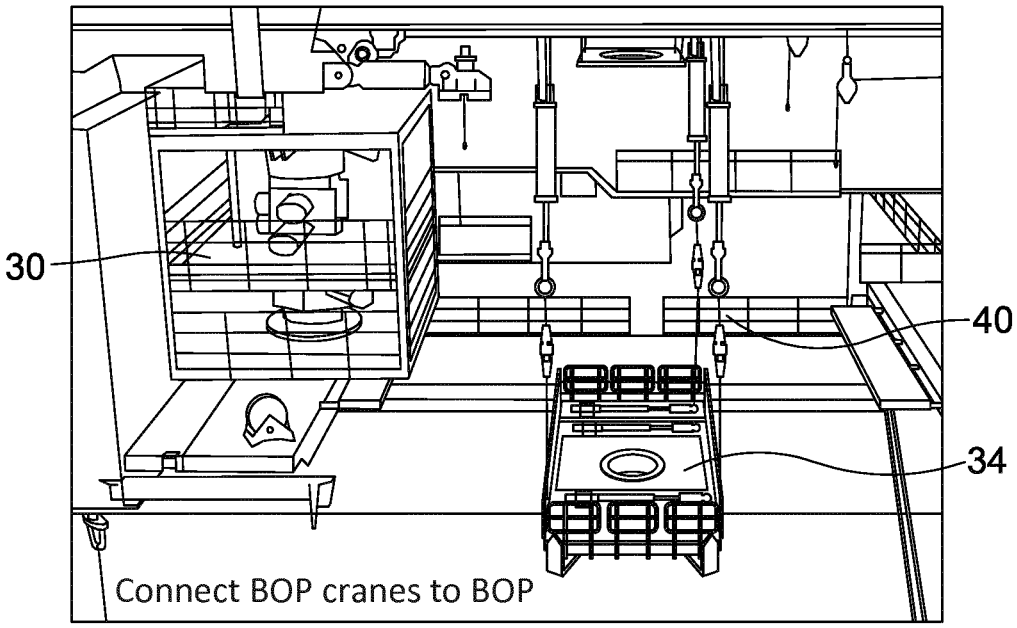
Figure 6U:
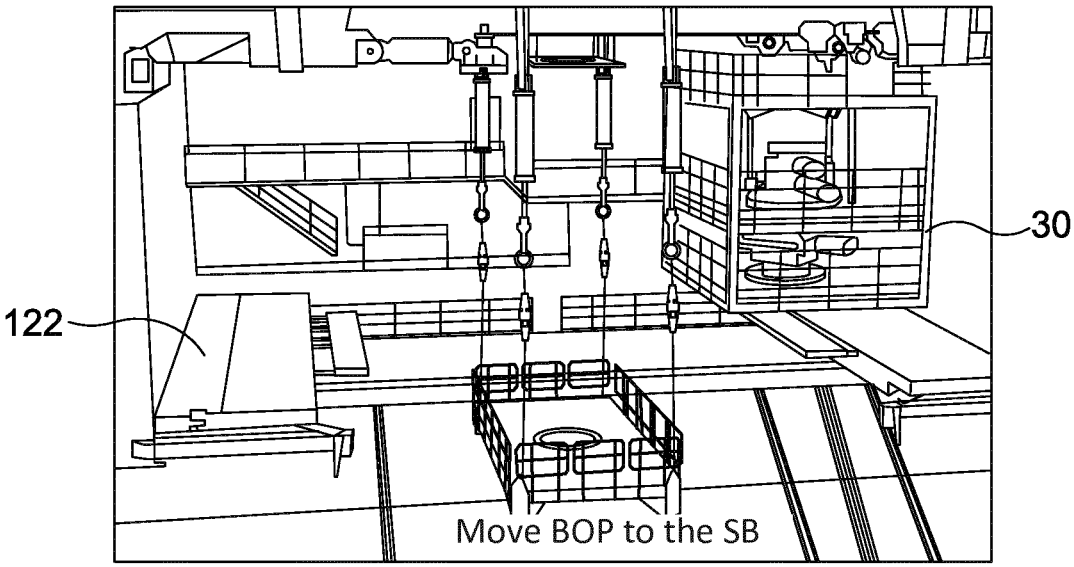
Figure 6V:
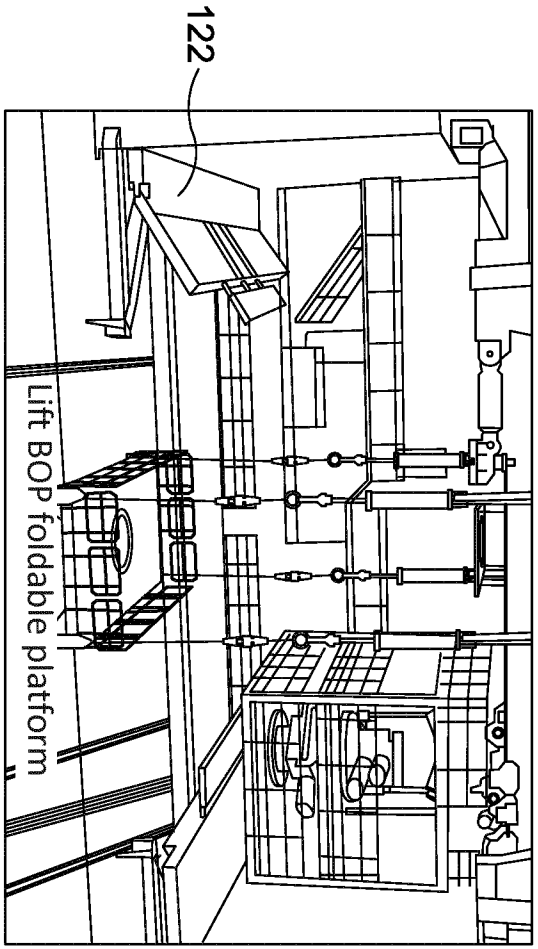
Figure 6X:
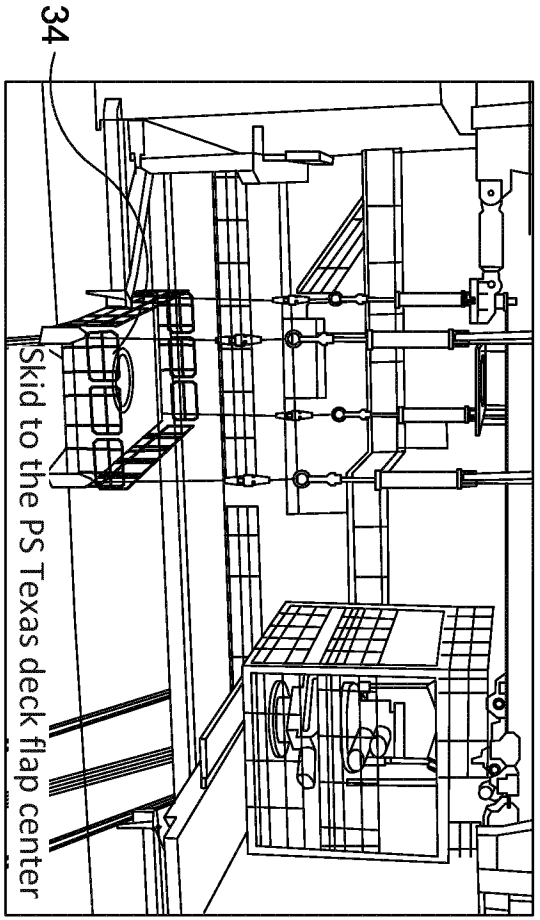

The crane operatively associated with the BOP crane ("the BOP crane") 120 is disconnected from the BOP stack 30 and translated to a position above the tension frame 34. The BOP crane 120 is operated to lift the tension frame 34, as shown in FIGS. 6P and 6Q.

Tension wires 40 are connected to the tension frame 34, the BOP crane 120 is then disconnected and operated to move the BOP stack 30 to the starboard side and BOP platform 122 is pivoted to a retracted position, as shown in FIGS. 6R to 6X.

Figure 6Y:
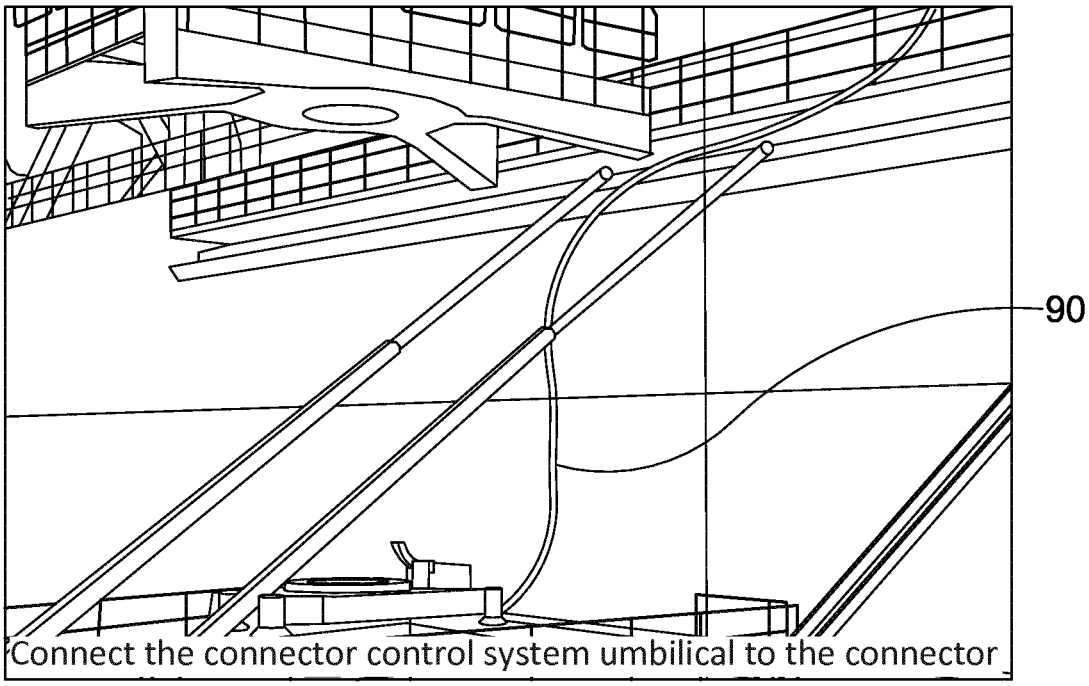
Figure 6Z:
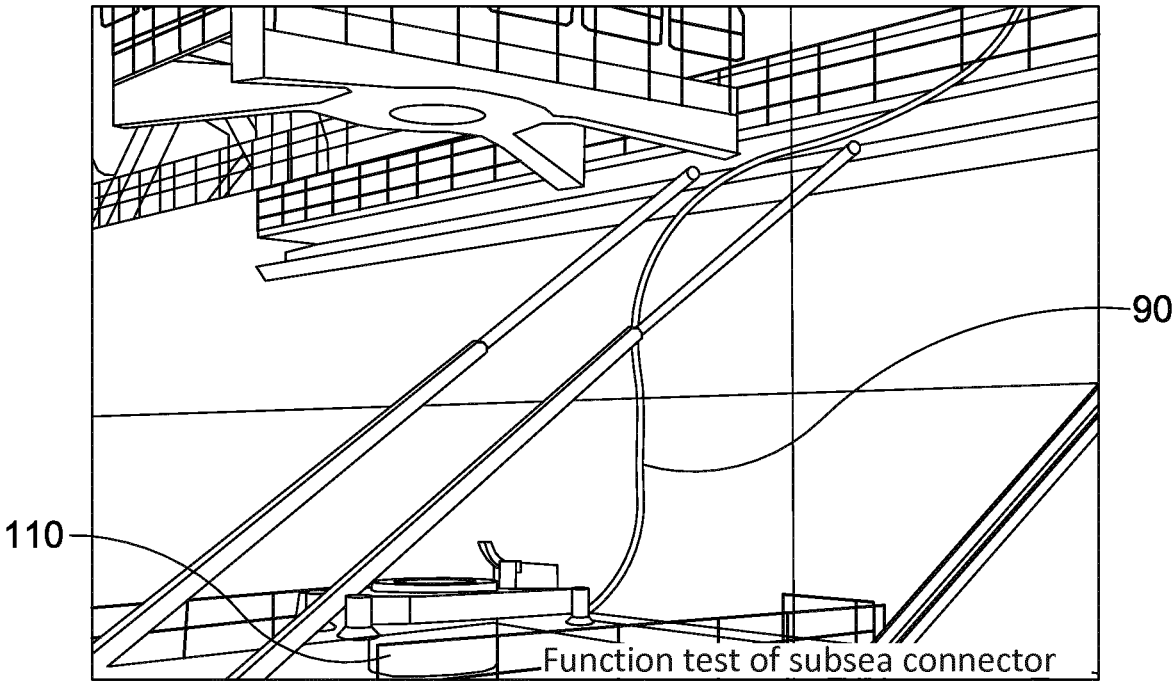
Figure 6A:
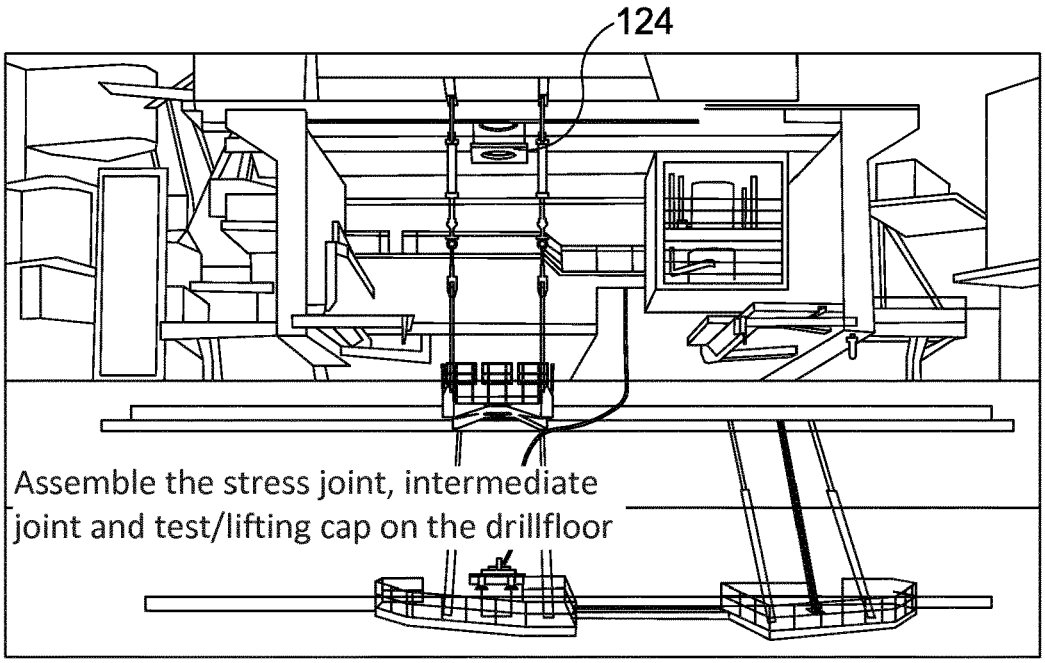
Figure 6A:
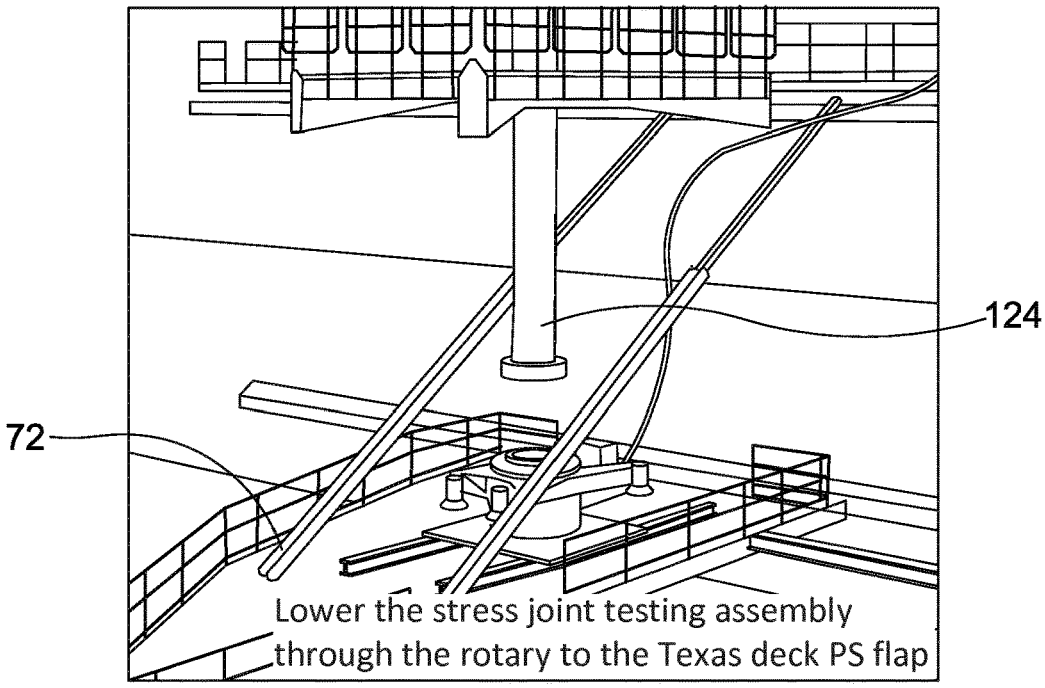
Figure 6A:
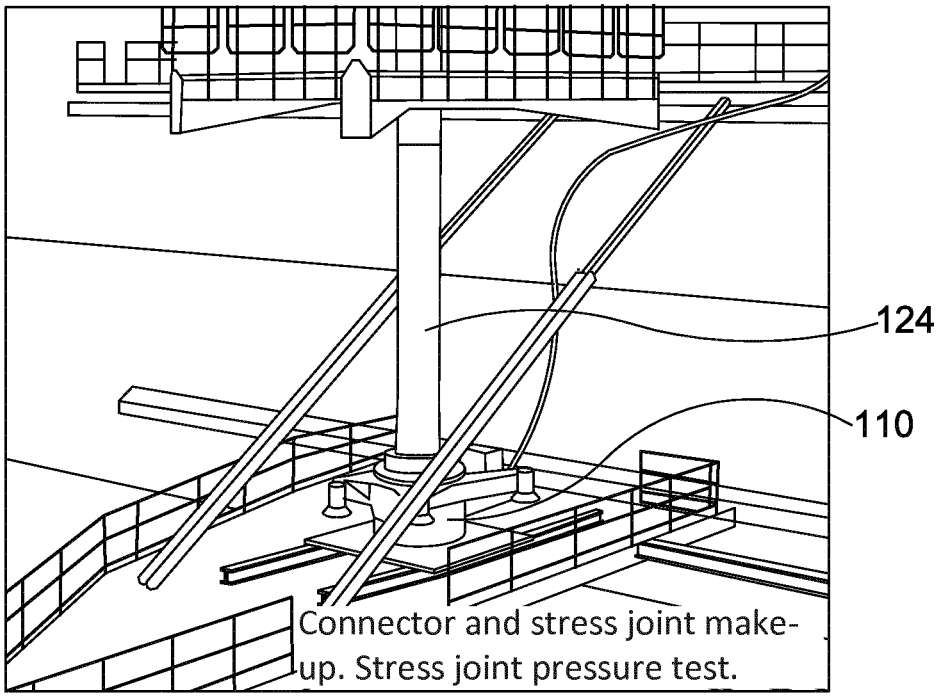
Figure 6A:
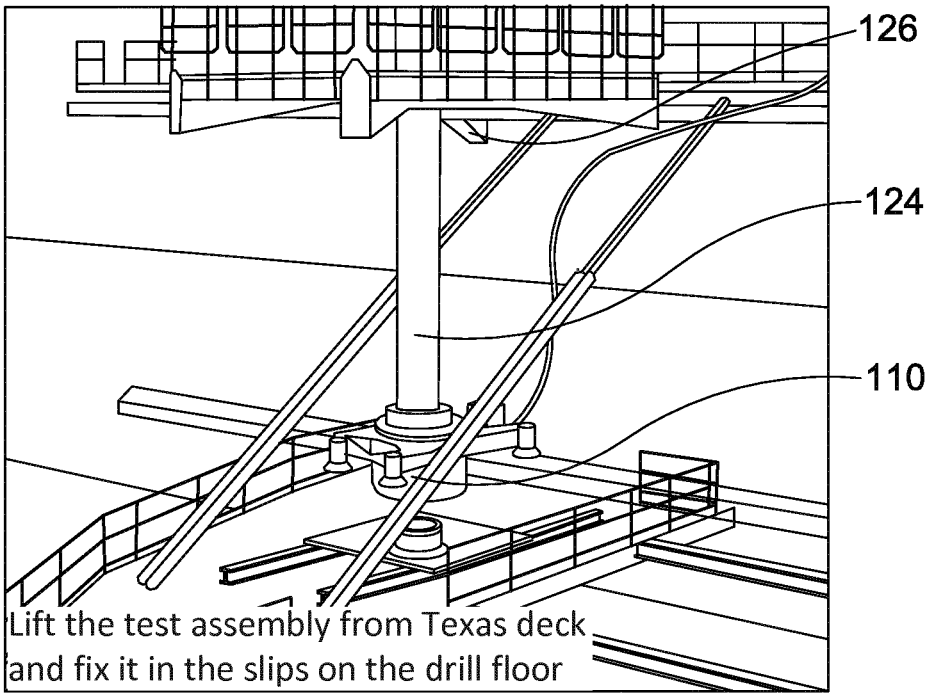
Figure 6A:
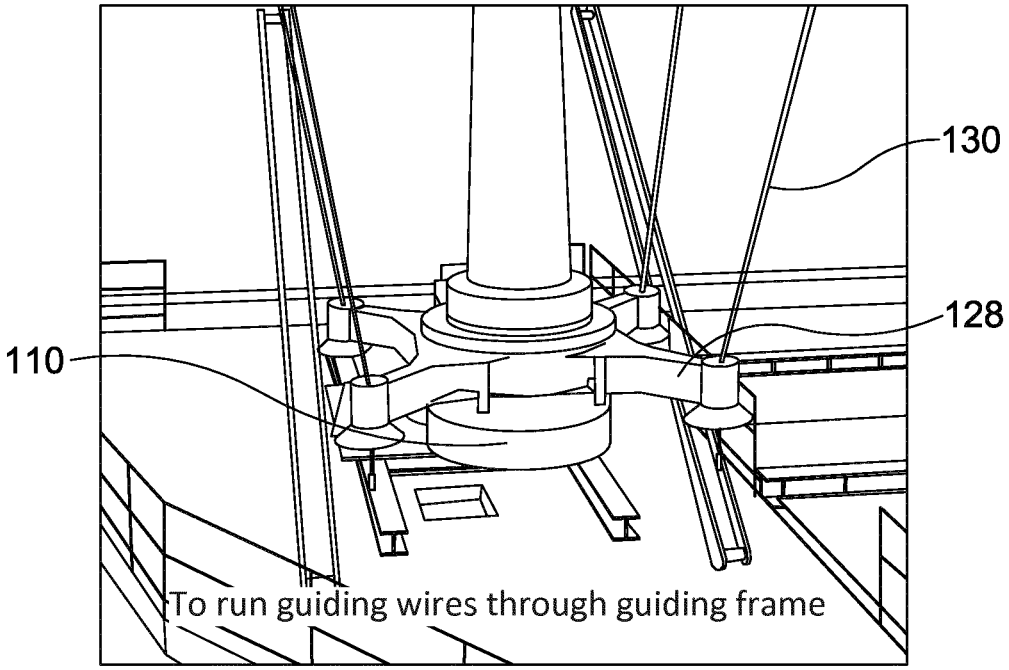
Figure 6A:
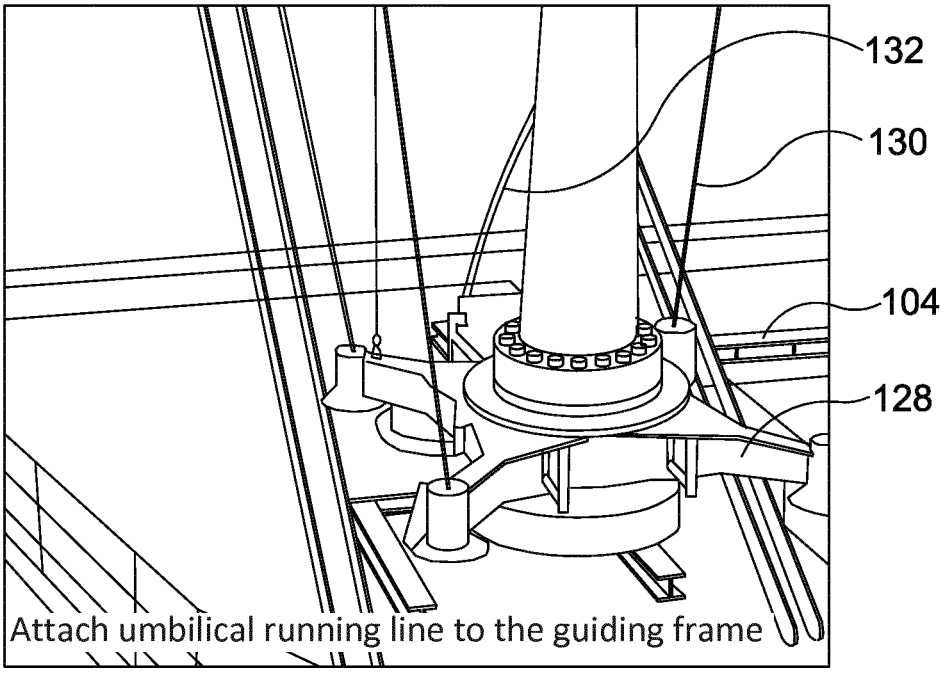
Figure 6A:
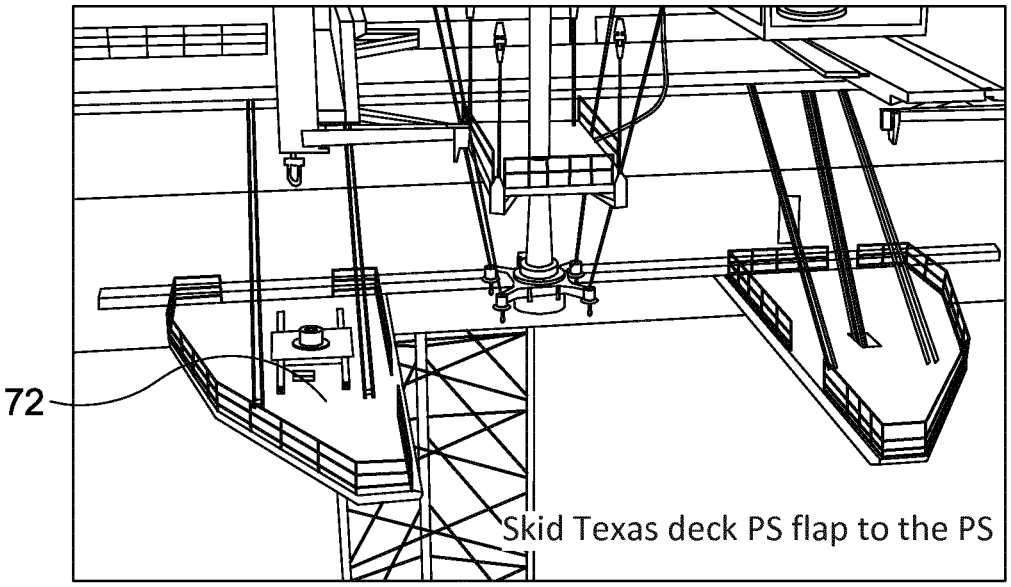
Figure 6A:
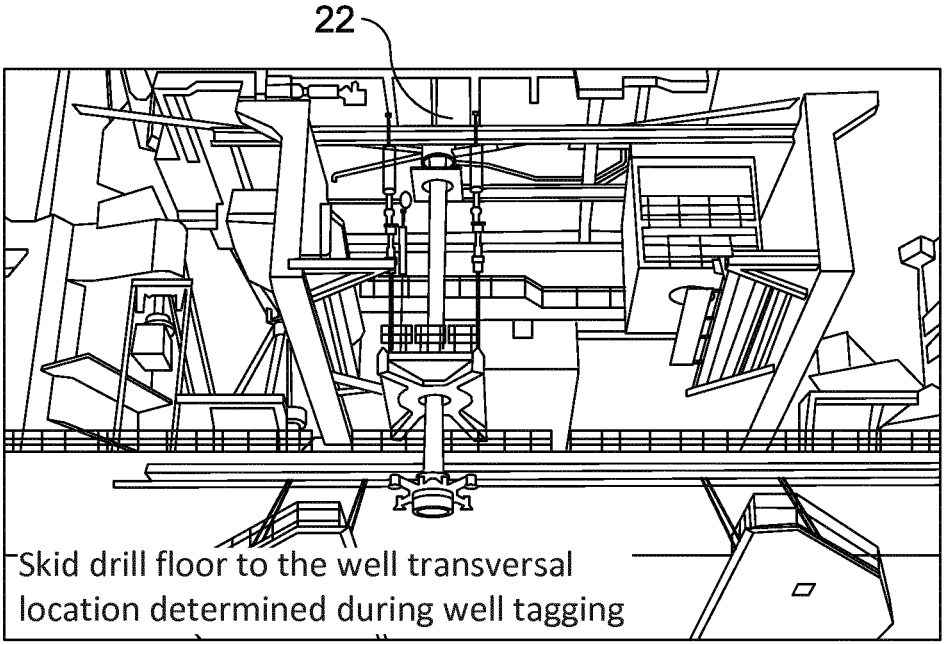

The tension frame 34 is then skilled to the port side access deck centre, following which the umbilical 90 is connected, and a function test is carried out on the subsea connector assembly 110 (as shown in FIGS. 6Y and 6Z).

As shown in FIGS. 6AA and 6AB, stress joint, intermediate joint and test/lifting cap assembly 124 are assembled on the drill floor 22 and the assembly 124 is lowered through the rotary table 24 to the port side flap 72 of the access deck 44.

The connector assembly 110 and assembly 124 is lifted from the access deck 44 and fixed in slips 126 on the drill floor 22 (as shown in FIGS. 6AC and 6AD).

The cantilever 18 is then skid out for deployment of guide frame 128, guiding wires 130 then being run through the guide frame 128, and an umbilical running line 132 is connected to the guide frame 128. In order to facilitate deployment, the beams 104 between the flaps 72, 102 are removed and the port side flap 72 is skid towards the port side. The drill floor 22 is then skid to the well transversal location during well tagging.

Figure 7A:
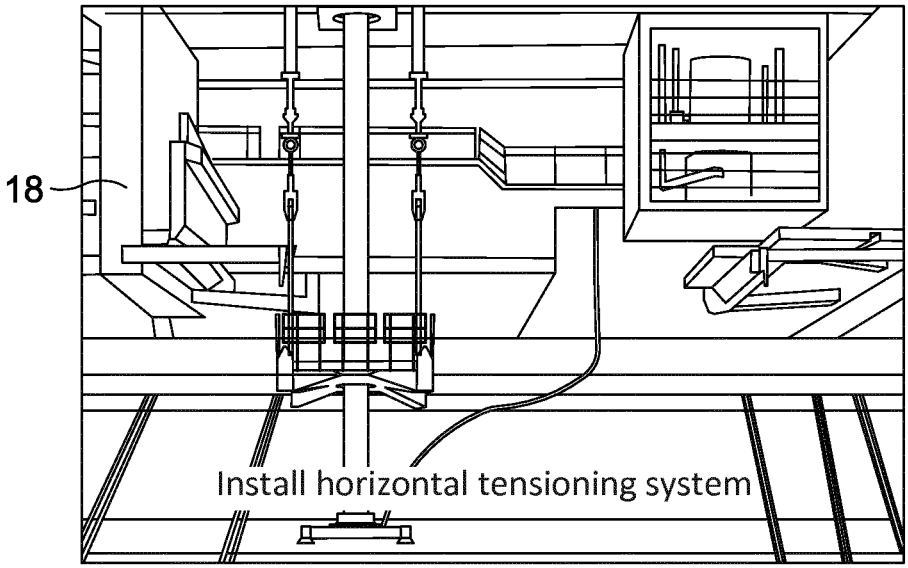
FIGS. 7A to 7U illustrate the system and method for supporting a riser in accordance with an example of the present disclosure.
Figure 7B:
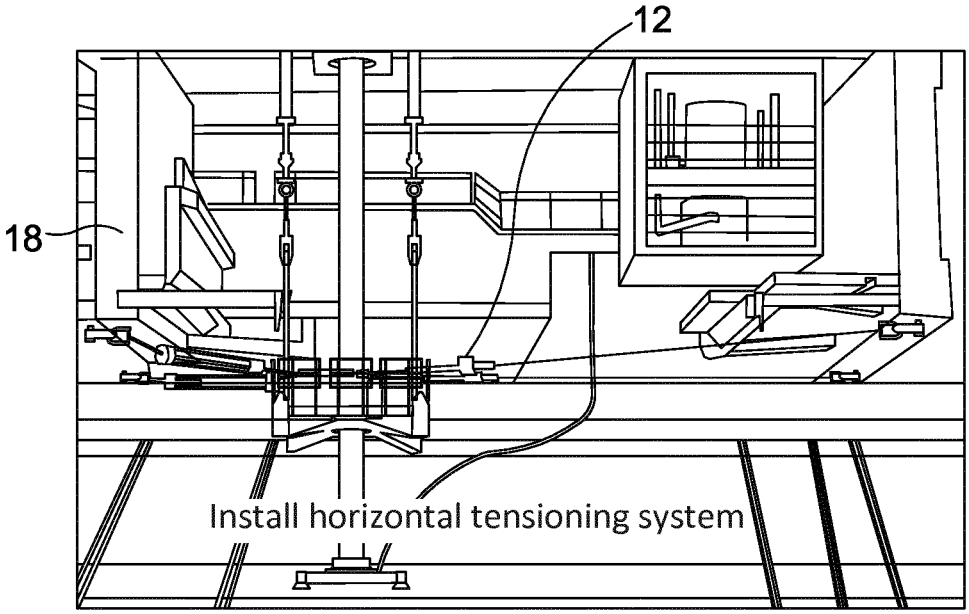
Figure 7C:
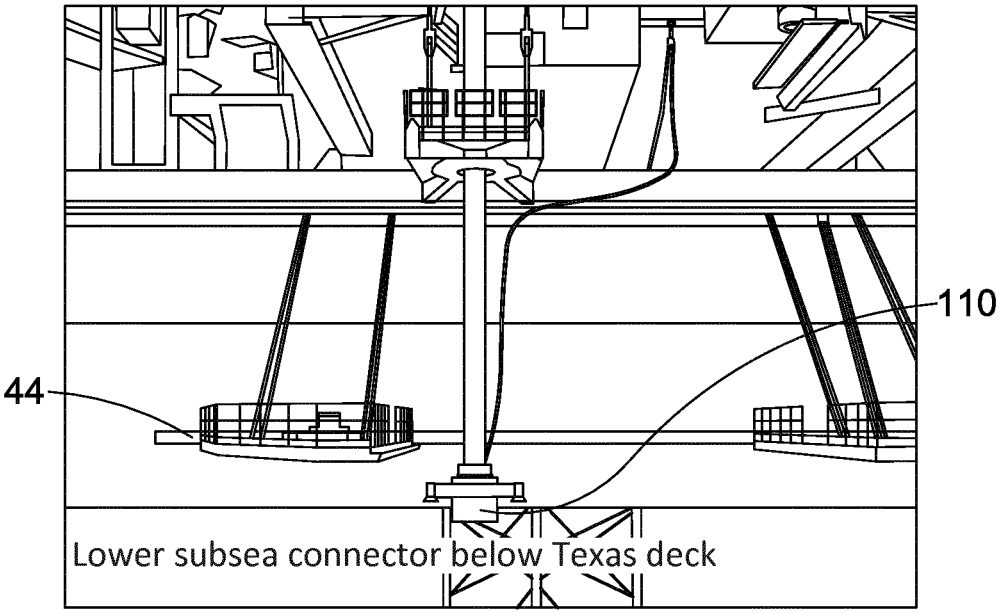
Figure 7D:
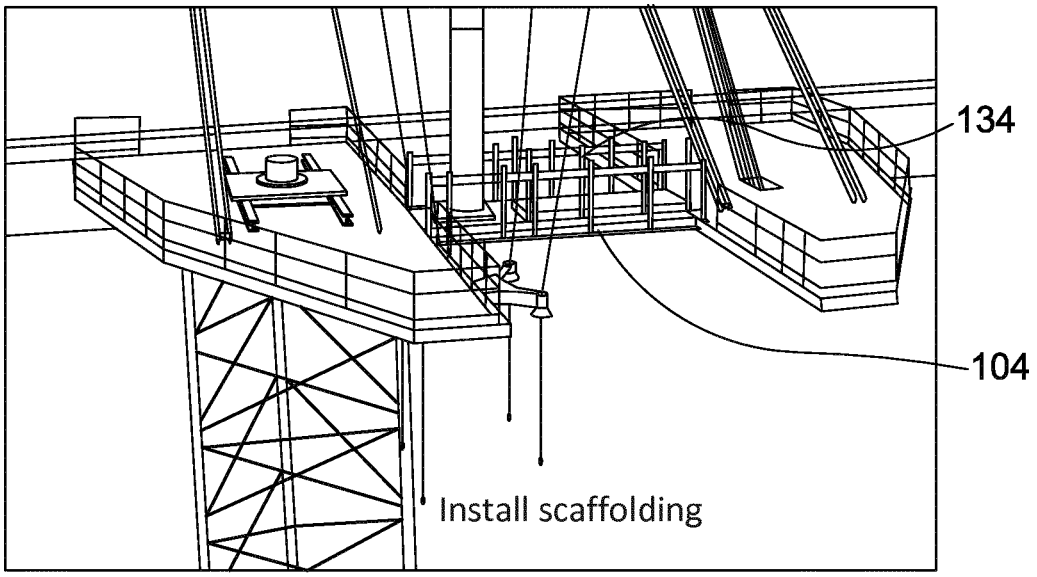
Figure 7E:
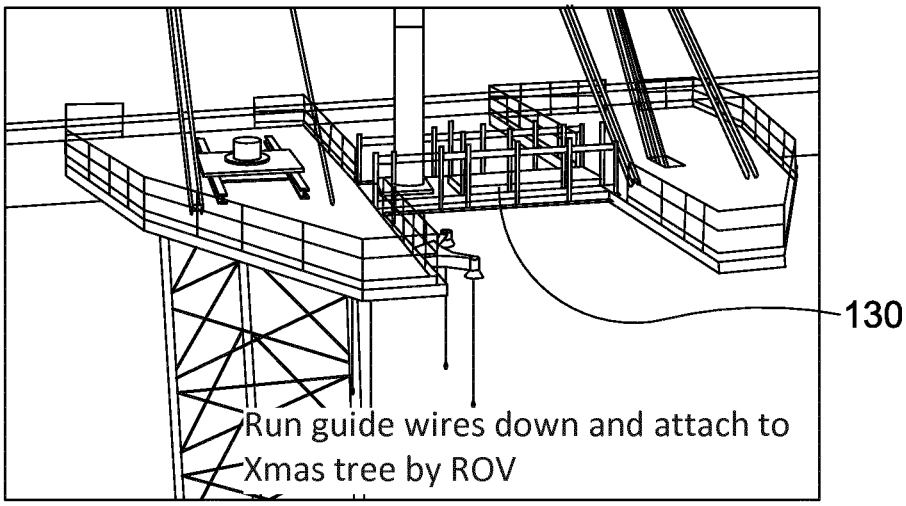
Figure 7F:
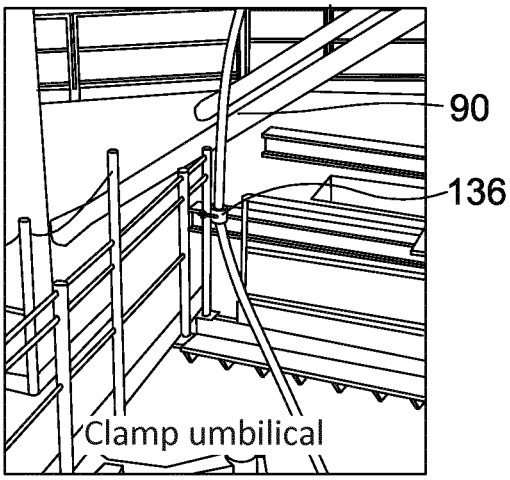
Figure 7G:
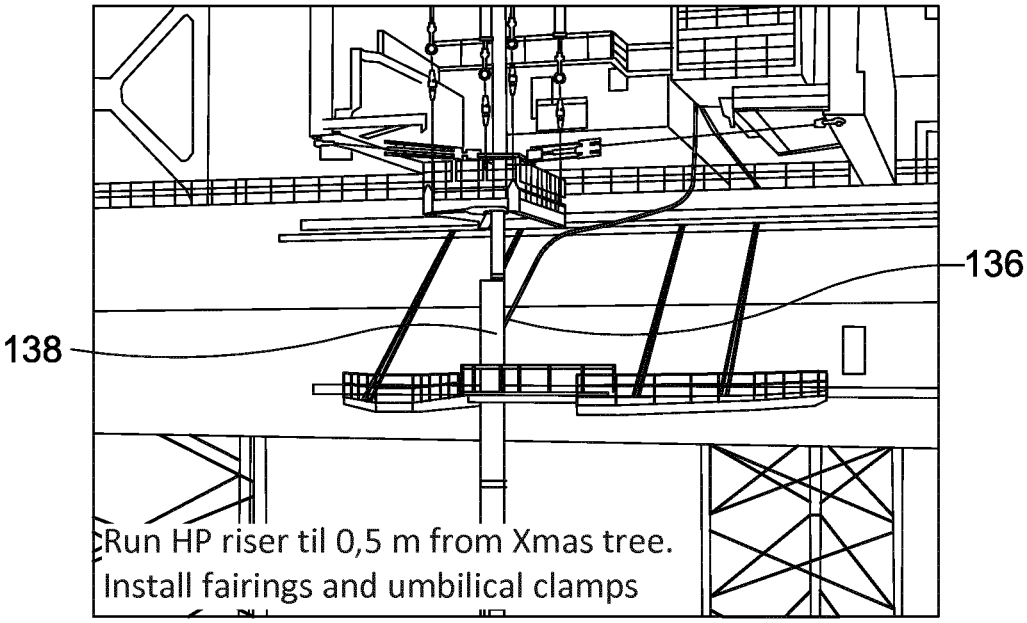
Figure 7H:
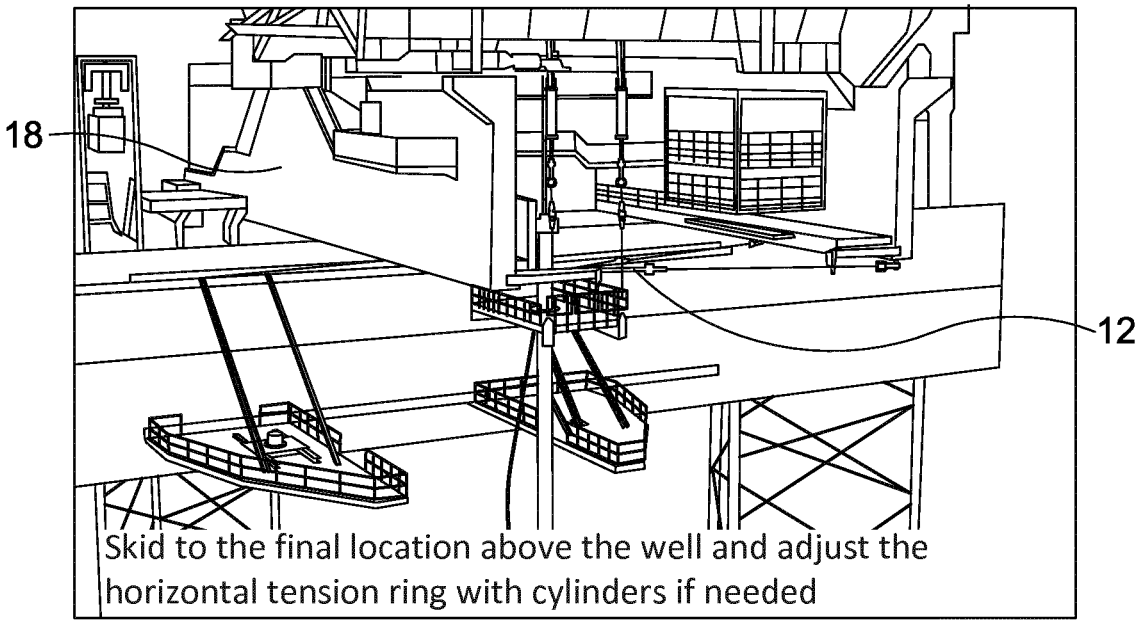
Figure 7I:
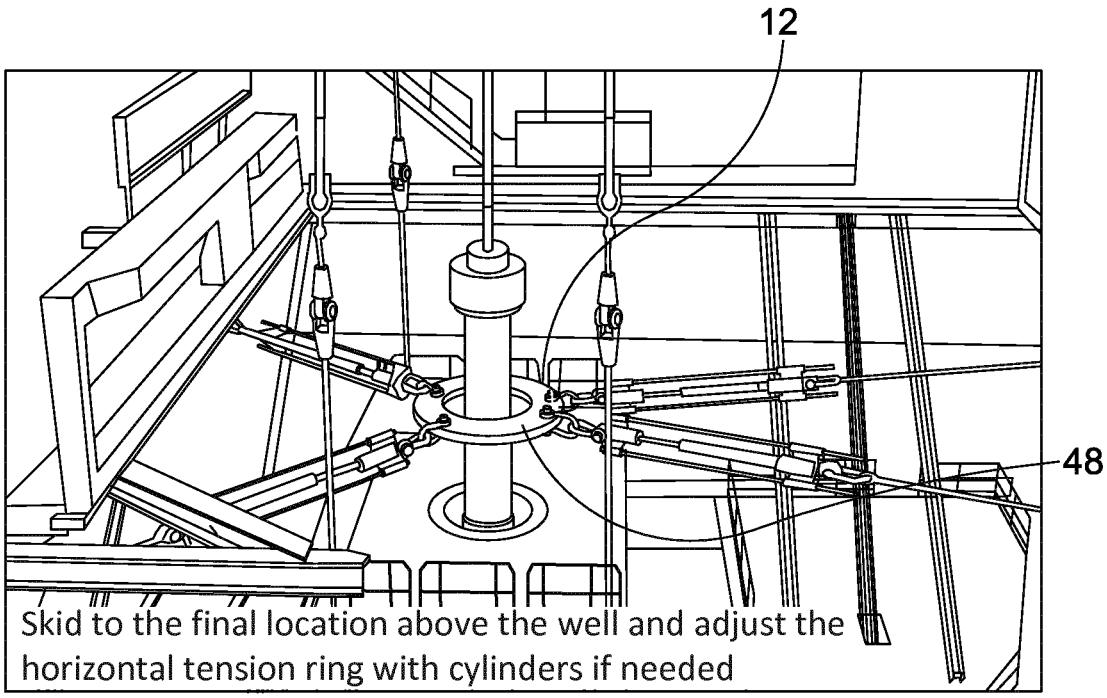
Figure 7J:
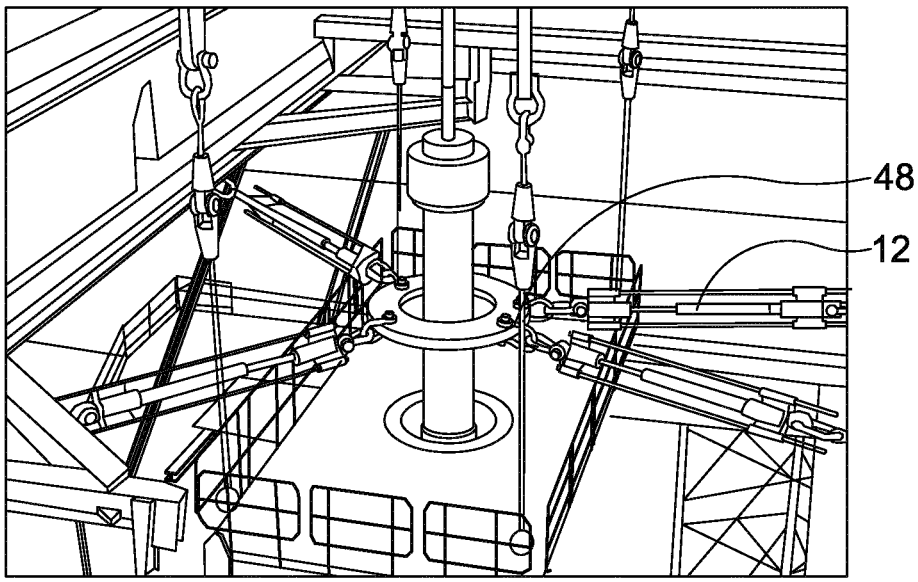
Figure 7K:
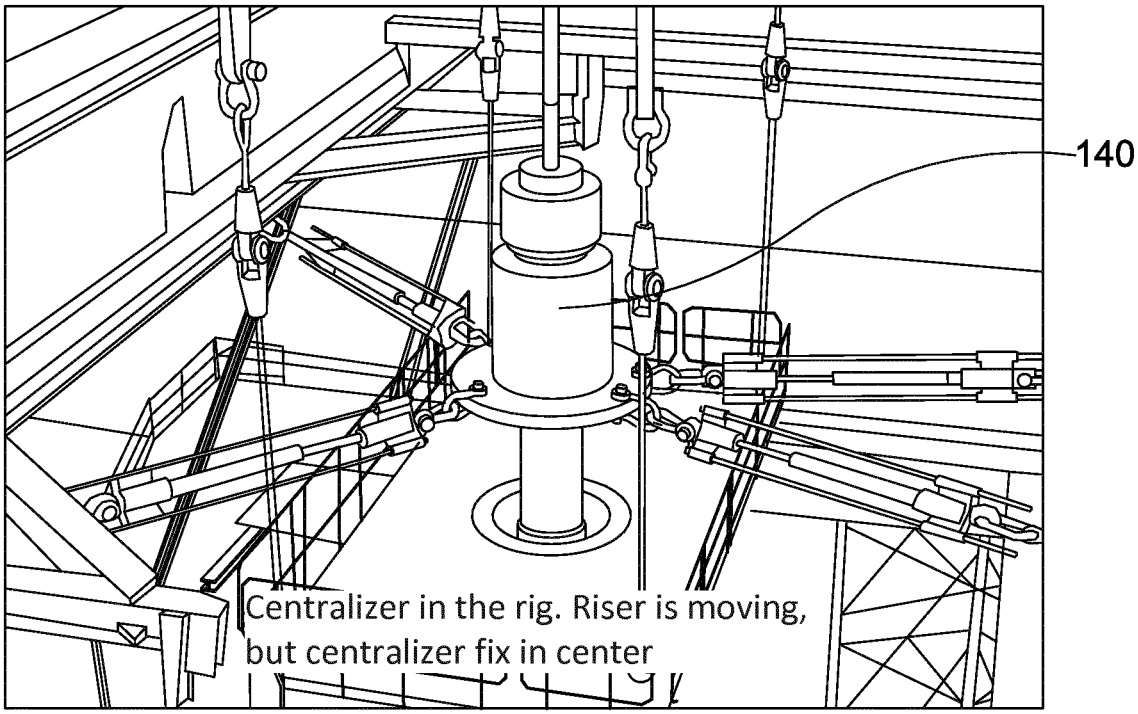
Figure 7L:
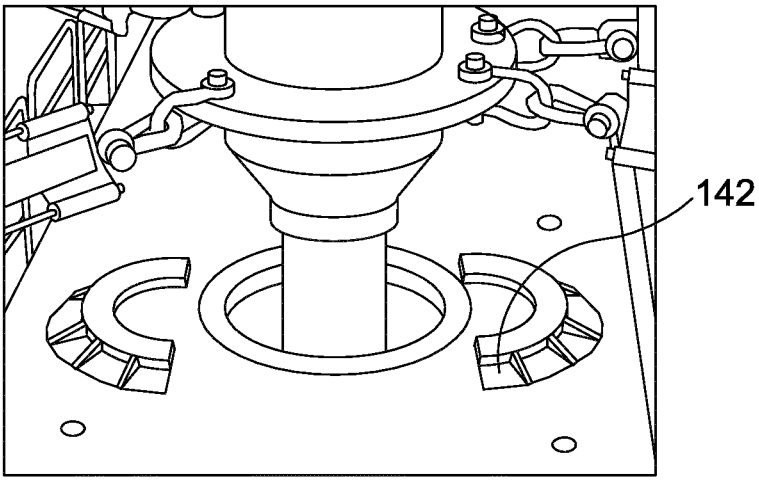
Figure 7M:
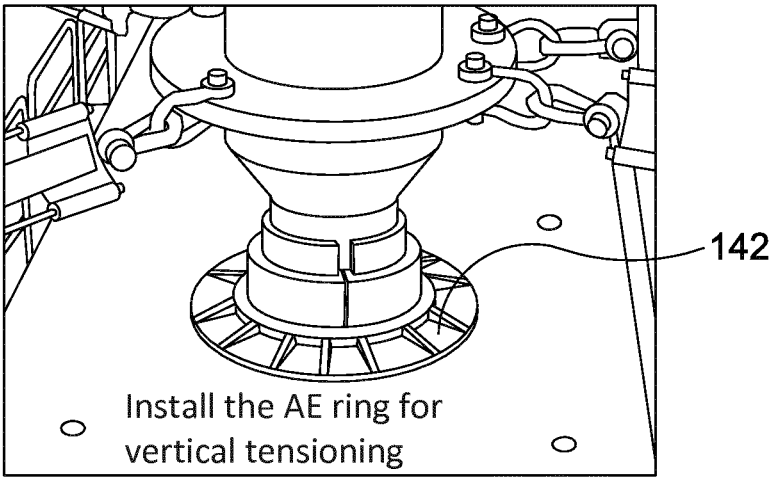

Reference is now made to FIGS. 7A to 7X of the accompanying drawings. Following the operations described above, the horizontal support system 12 is then installed.

As shown, the support system 12 is coupled to the cantilever 18 via the connector arrangement 68 as described above, the riser interface 48 disposed around the riser 32.

The subsea connector assembly 110 is then lowered below the access deck 44.

Beams 104 are again installed between the flaps 72, 102 of the access deck 44 and scaffolding 134 installed.

The guide wires 130 are then run and attached to a subsea Christmas tree by a remotely operated vehicle (not shown).

As shown, a clamp 136 is used to secure the umbilical 90.

The riser 32 is then run in stages until the riser 32 reaches a position above the Christmas tree. As each stage is run, fairings 138 and umbilical clamps 136 are installed.

Once the first stage of operations has been completed, the scaffolding 134 and beams 104 are removed.

The cantilever 18 is then skid to the second location above a second well (not shown).

The horizontal support system 12 is adjusted to suit the second location, if required.

A centraliser 140 is installed.

The subsea connector assembly 110 is connected to the Christmas tree.

The top drive 26 is operated to apply an over pull.

A vertical tensioning ring 142 is then installed and the tension frame 34 is lifted using hydraulic cylinders to apply tension.

Figure 7N:
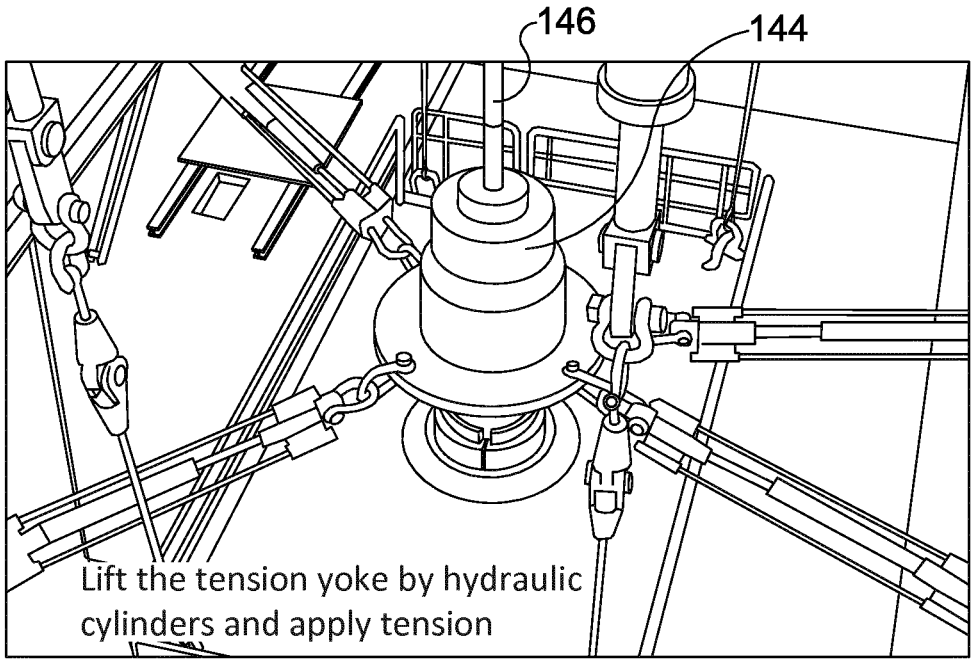
Figure 7O:
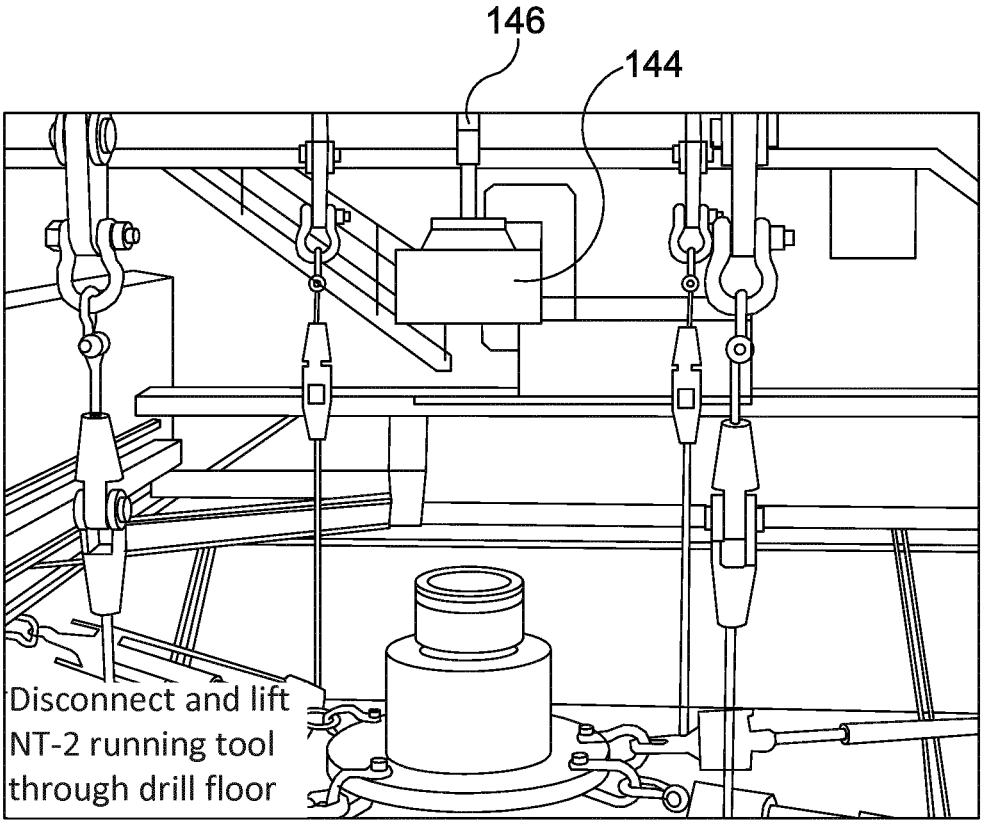
Figure 7P:
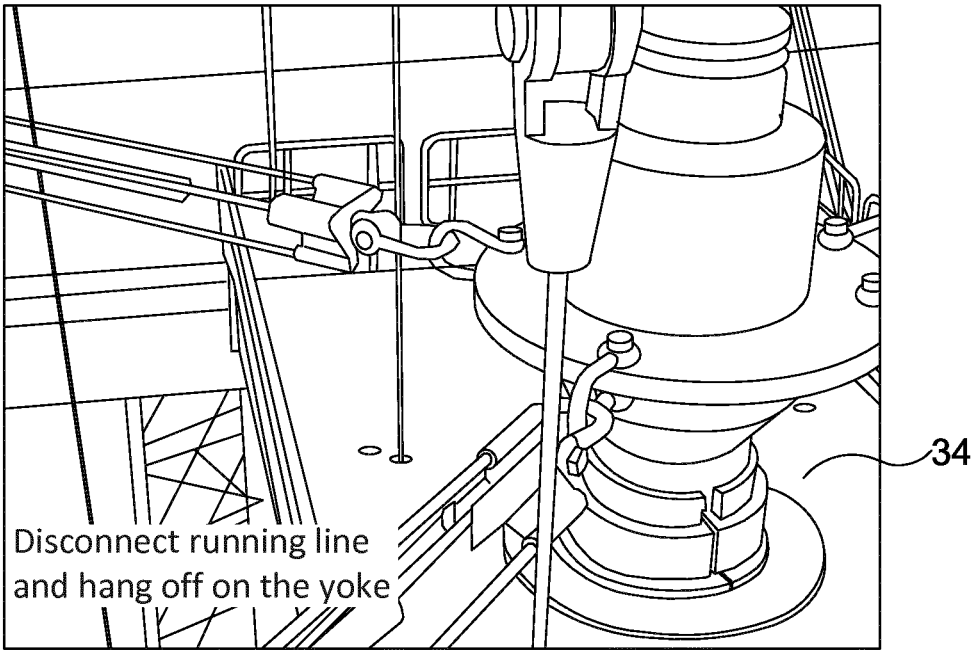
Figure 7Q:
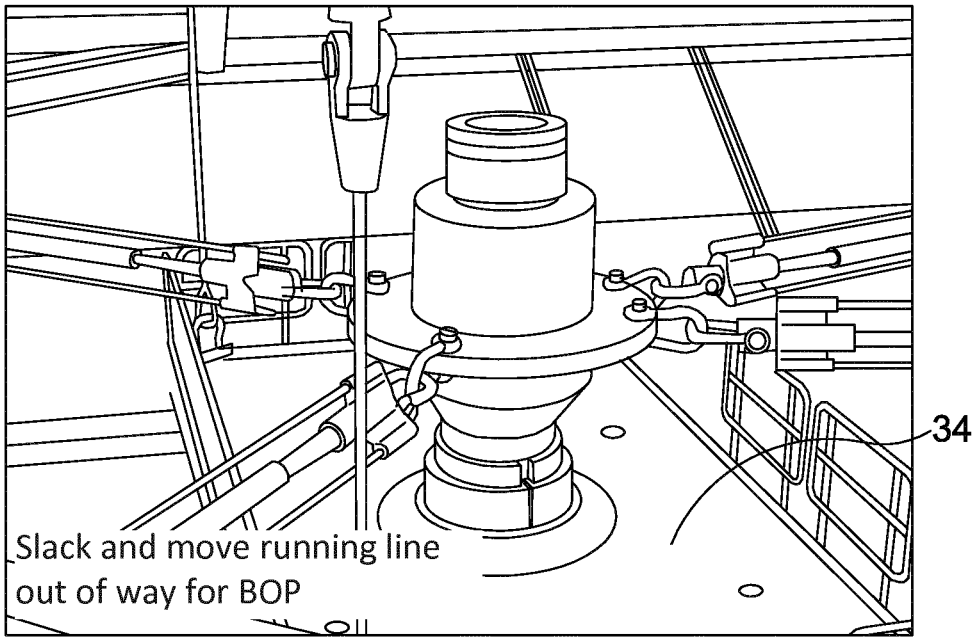
Figure 7R:
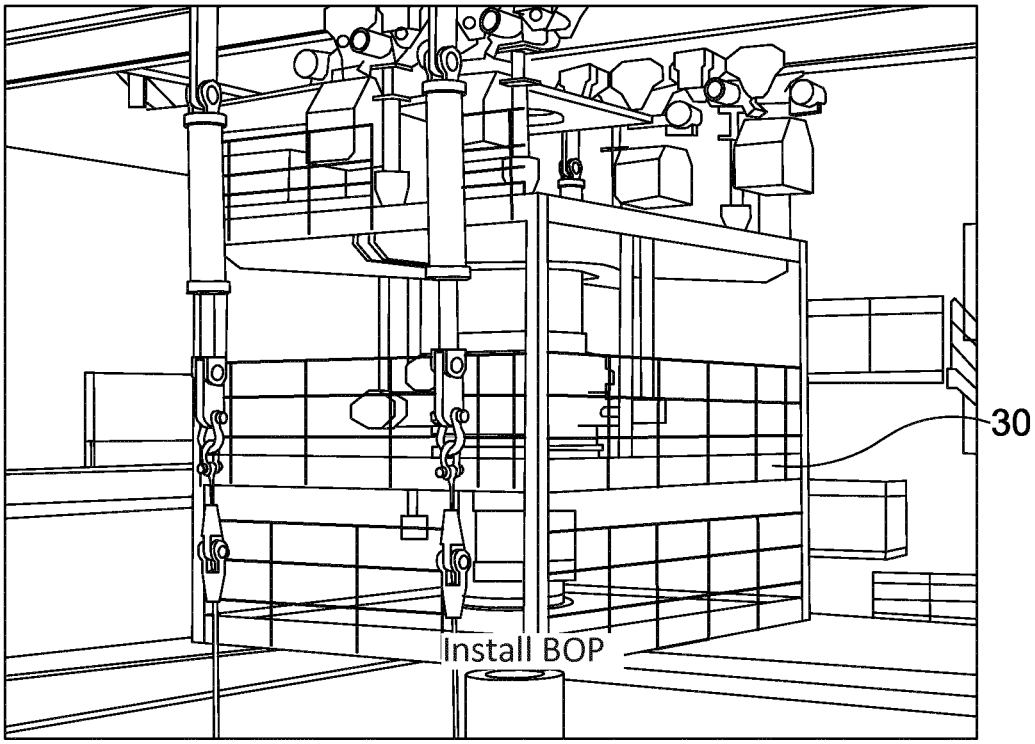
Figure 7S:
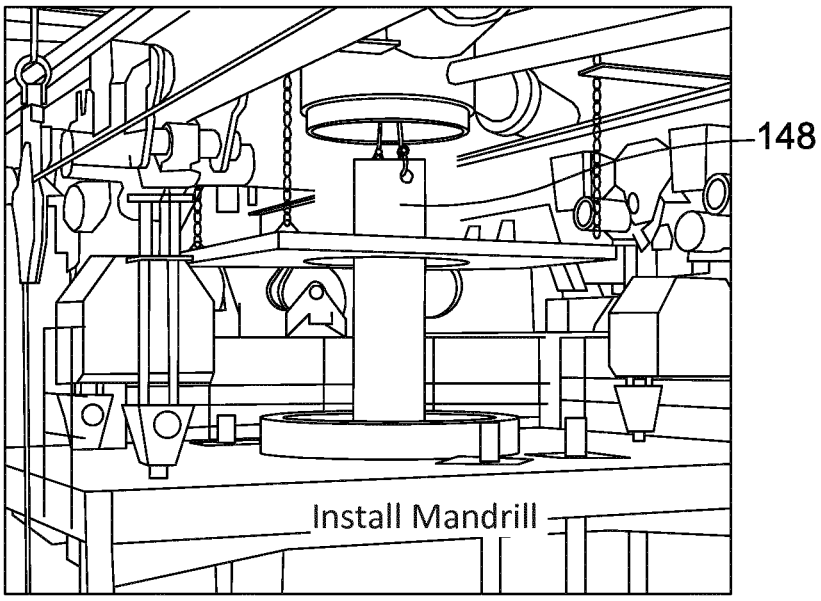
Figure 7T:
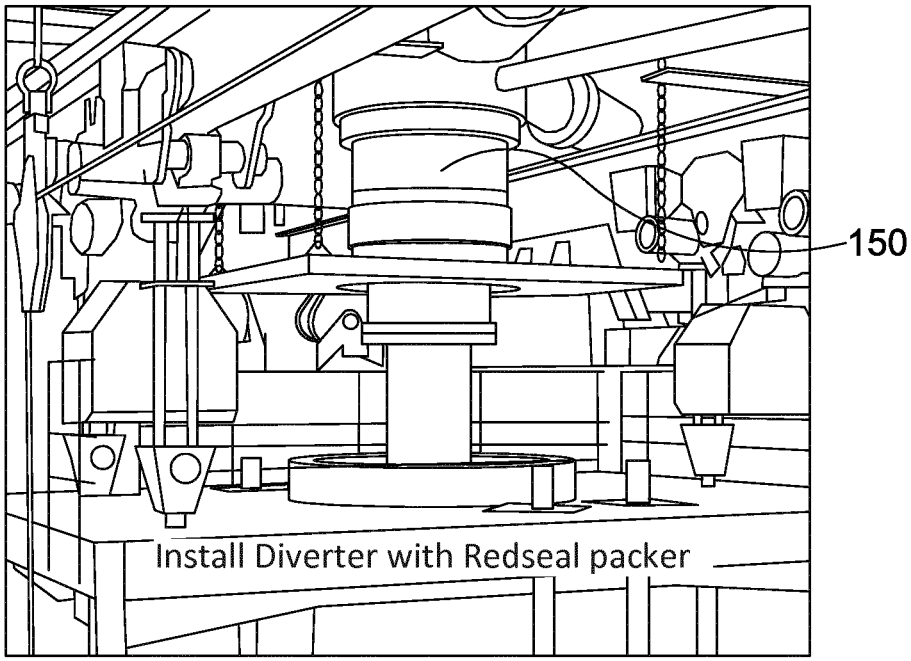
Figure 7U:
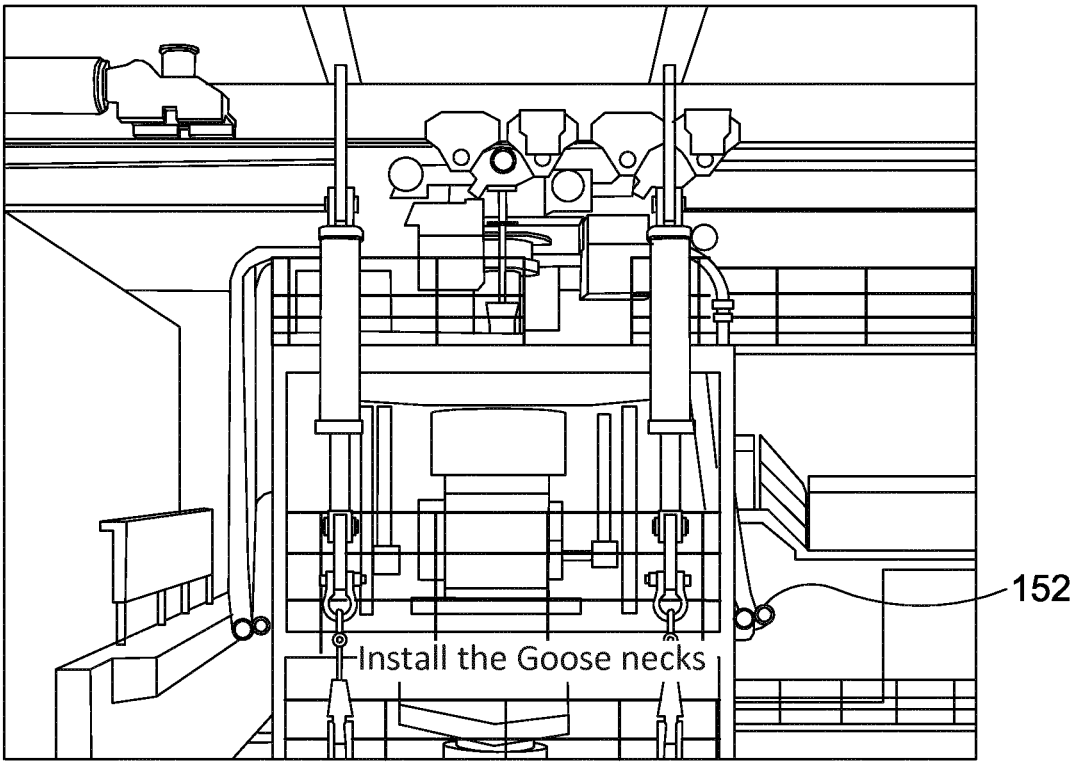
Figure 8A:
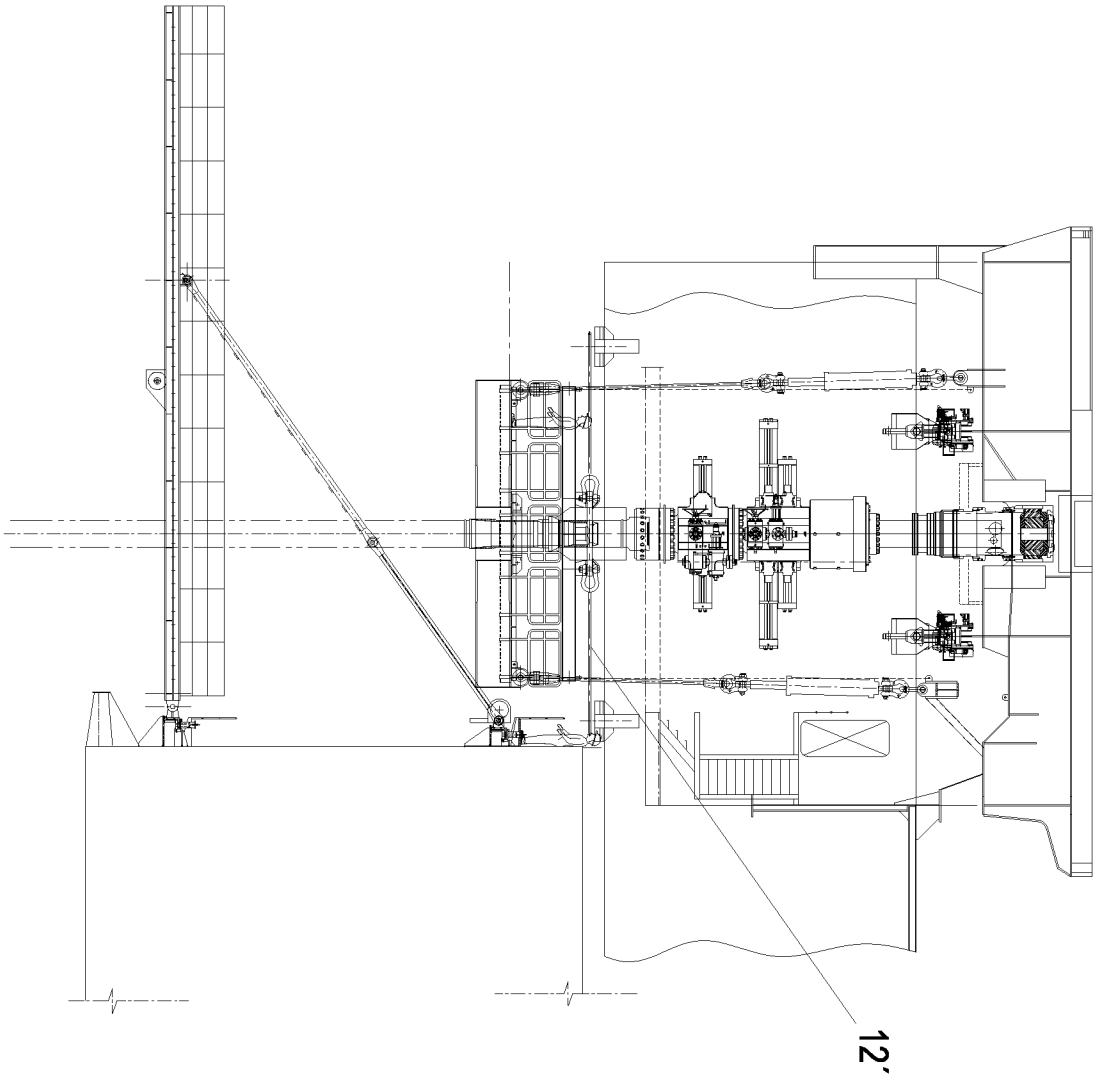
FIGS. 8A to 8D show a support system according to another example of the present disclosure.
Figure 8B:
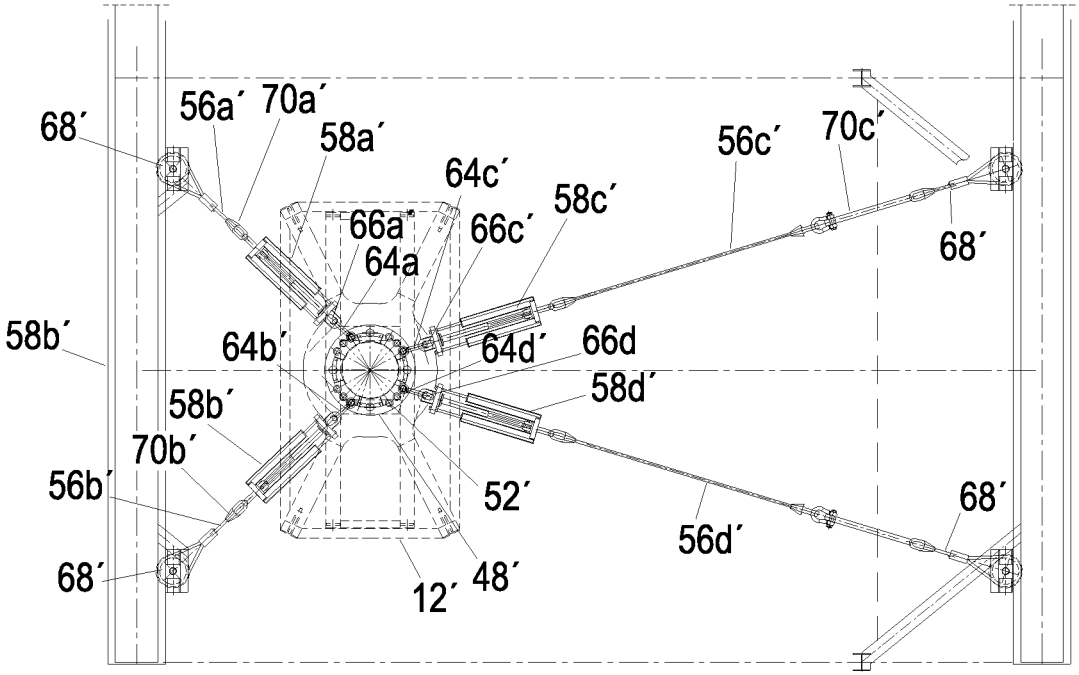
Figure 8C:
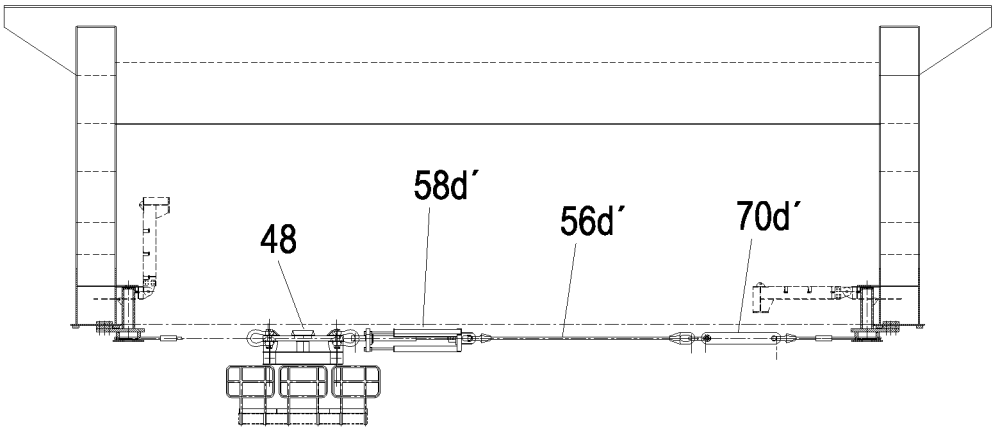
Figure 8D:
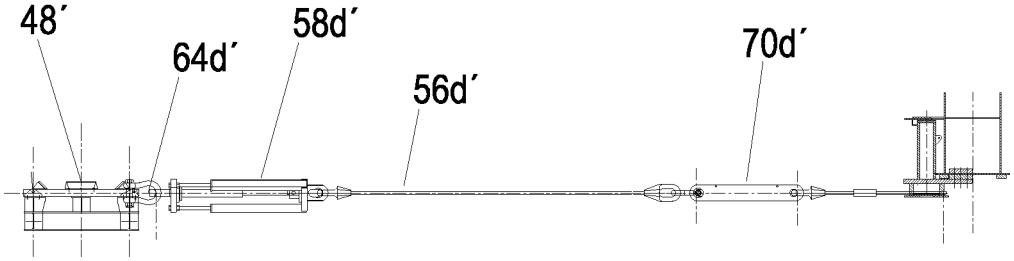

As shown in FIGS. 7N, 70 and 7R, running tool 144 and running line 146 are removed hung off the tension frame 34, the running line 146 moved out of the way so that the BOP stack can be installed. The BOP stack 30 is then installed.

Finally, a mandrill 148, a diverter and packer assembly 150, and goose necks 152 are then installed.

It will be understood that the above examples are exemplary only and that various modifications may be made without departing from the scope of the invention.

For example, FIGS. 8A to 8D shows a support system 12' according to another example of the present disclosure. Like components of the support system 12 and 12' are represented with like numerals.

As shown, the support system 12' comprises a riser interface 48' and a tether arrangement 50'.

Beneficially, the support system 12' provides for symmetric and asymmetric placement of the riser interface 48' relative to the cantilever 18'. The riser interface 48' may thus be adjusted to any position on an X-Y plane. Moreover, the support system 12' facilitates interventions operations to be carried out with reduced manual interface or with no manual interface, with corresponding reduced risk to personnel operating in the environment.

In the illustrated embodiment, the riser interface 48' takes the form of a ring member. In use, the riser interface 48' surrounds the riser 32 and has a number of bores 52' defining attachment locations for the tether arrangement 50'. In the illustrated example, sixteen bores 52' are provided. However, it will be recognised that any suitable number of bore 52' may be provided.

The tether arrangement 50' is adjustable to adjust the horizontal position of the riser interface 48'.

The tether arrangement 50' includes a number of tethers 54*a*', 54*b*', 54*c*' and 54*d*'. Tether 54*a*' defines a port side fore tether. Tether 54*b*' defines a port side aft tether. Tether 54*c*' defines a starboard side fore tether. Tether 54*d*' defines a starboard side aft tether. It will be recognised that the tether arrangement 50' may comprise more or fewer tethers.

Each of the tethers 54*a*', 54*b*', 54*c*', 54*d*' comprises a first, cable, portion 56*a*', 56*b*', 56*c*', 56*d*'. In the illustrated example, the first portion 56*a*', 56*b*', 56*c*', 56*d*' of each of the tethers 54*a*', 54*b*', 54*c*', 54*d*' comprises wire rope, in particular but not exclusively steel wire rope.

Each of the tethers 54*a*', 54*b*', 54*c*', 54*d*' comprises an actuator 58*a*', 58*b*', 58*c*', 58*d*'. The actuators 58*a*', 58*b*', 58*c*', 58*d*' are coupled between the respective first, cable, portions 56*a*', 56*b*', 56*c*', 56*d*' and the riser interface 48'. The actuators 58*a*', 58*b*', 58*c*', 58*d*' together form an actuator arrangement 60' of the support system 12'. In use, the actuators 58*a*', 58*b*', 58*c*', 58*d*' are configured—by adjustment in the length/stroke—to adjust the horizontal position of, provide horizontal support to, and/or apply tensile force to, the riser interface 48'. In the illustrated example, the actuators 58*a*', 58*b*', 58*c*', 58*d*' take the form of hydraulic linear actuators. However, it will be understood that a mechanical arrangement, e.g. a turnbuckle arrangement or the like, may alternatively or additionally be provided.

A coupling arrangement 62' is provided for coupling the tethers 54*a*', 54*b*', 54*c*', 54*d*' to the riser interface 48'. In the illustrated example, the coupling arrangement 62' takes the form of chain links 64*a*', 64*b*', 64*c*', 64*d*' which engage the bores 52' and pad eyes 66*a*', 66*b*', 66*c*', 66*d*' connected to, or formed on, the actuators 58*a*', 58*b*', 58*c*', 58*d*'.

A connector arrangement 68' is provided for coupling the tethers 54*a*', 54*b*', 54*c*', 54*d*' to the cantilever 18. In the illustrated example, the connector arrangement 68' takes the form of swivel connectors e.g. in the form of tie rods 70'.

In use, the tether arrangement 50' may be operable to locate the riser interface 48' at a desired location, the tether arrangement 50' being lockable to maintain the position of the riser interface 48' at the desired location. Beneficially, examples of the present disclosure permit the riser interface 48' to be located and locked in position before the riser 32' is in place, such that the actuator arrangement is not exposed to loads imparted by the riser 32'. Moreover, examples of the present disclosure also provide safety benefits for personnel, since manual operations may be reduced or eliminated.

The support system 12' is configured to apply a tensile force to the riser interface 48' using the tethers 54*a*', 54*b*', 54*c*', 54*d*' of the tether arrangement 50'.

The ability to apply tensile force and to lock the tether arrangement 50' may thus be configured to pre-tension the riser interface 48'.

Beneficially, in examples of the present disclosure the actuators 58*a*', 58*b*', 58*c*', 58*d*' can be smaller than otherwise necessary, as they are only used to position and tension the riser interface 48', and not to position the riser 32 itself.

Thereafter, the support system 12' is configured to passively provide horizontal support to the riser interface 48'. For example, once installed the support system 12 passively supports the riser interface 48'—and in use the riser 32. Beneficially, the support system 12 does not require complex ongoing and active control systems during operations.

Beneficially, supporting and/or carrying the support system 12' on the cantilever 18 permits the horizontal support system 12' to move with the cantilever 18 and may for example permit the support system 12' to be located at a position beyond the reach of the access deck 44 increasing the flexibility and operational reach of the support system 12'.

The invention claimed is:

1. A support system for providing horizontal support to a riser extending downward from a drilling cantilever comprising a drilling floor defining a well centre and into a body of water, the support system comprising:

a riser interface defining a vertical opening for receiving the riser; and a tether arrangement comprising a plurality of tethers for tethering the riser interface to the drilling cantilever, the tether arrangement configured to permit displacement of the riser interface in the X and Y directions of the drilling cantilever, wherein the well centre may be different from a centre axis of the cantilever and the support system is mounted to the drilling cantilever and configured to permit asymmetric placement of the riser interface relative to the drilling cantilever.

2. The support system of claim 1, wherein the support system is configured so that each of the tethers is arranged at a given angle relative to the riser interface.

3. The support system of claim 2, wherein the tethers are arranged at an angle relative to the riser interface so as to permit the position of the riser interface to be adjusted and to support the riser interface.

4. The support system of claim 1, wherein the riser interface comprises a ring member.

5. The support system of claim 1, wherein the riser interface comprises a plurality of attachment locations.

6. The support system of claim 1, wherein the tether arrangement comprises an actuator arrangement having one or a plurality of hydraulic actuators.

7. The support system of claim 6, wherein the actuator arrangement comprises a mechanical arrangement.

8. The support system of claim 1, wherein the tether arrangement is lockable.

9. The support system of claim 1, wherein the support system is configured to apply a tensile force to the riser interface, and wherein the support system is configured to pre-tension the riser interface.

10. The support system of claim 1, wherein the support system is configured to passively provide horizontal support to the riser interface.

11. The support system of claim 1, comprising a coupling arrangement for coupling the riser interface to the tether arrangement.

12. The support system of claim 1, comprising a connector arrangement for connecting the tether arrangement to the drilling cantilever.

13. The support system of claim 12, wherein the connector arrangement comprises a swivel connector.

14. The support system of claim 1, further comprising a tension frame suspended below the drilling cantilever for vertically supporting the weight of the riser.

15. The support system of claim 14, further comprising a connector arrangement for attaching the tether arrangement to anchor points on the drilling cantilever, wherein the tension frame is suspended below the support system and the support system is configured to passively provide horizontal support to the riser interface.

16. A bottom supported offshore drilling platform comprising a support system for providing horizontal support to a riser extending downward from a drilling cantilever of the offshore platform along a well centre and into a body of water, said drilling cantilever comprising a drilling floor defining the well centre, the support system comprising:

a riser interface defining a vertical opening for receiving the riser; and a tether arrangement comprising a plurality of tethers for tethering the riser interface to a connector arrangement on the drilling cantilever, the tether arrangement configured to permit displacement of the riser interface in the X and Y directions of the drilling cantilever, wherein the well centre may be off a centre axis of the drilling cantilever and the support system is mounted to said drilling cantilever and configured to provide tensile support to the riser and permit asymmetric placement of the riser interface relative to the drilling cantilever.

17. The offshore platform of claim 16, wherein said well centre may be shifted transversely relative to the drilling cantilever.

18. A method for supporting a riser using a support system for providing horizontal support to the riser extending downward from a drilling cantilever of an offshore platform along a well centre and into a body of water, said drilling cantilever comprising a drilling floor defining the well centre, the support system comprising:

a riser interface defining a vertical opening for receiving the riser; and a tether arrangement comprising a plurality of tethers for tethering the riser interface to a connector arrangement on the drilling cantilever, the tether arrangement configured to permit displacement of the riser interface in the X and Y directions of the drilling cantilever, wherein the well centre may be off a centre axis of the drilling cantilever and the support system is mounted to said drilling cantilever and configured to provide tensile support to the riser and permit asymmetric placement of the riser interface relative to the drilling cantilever.

* * * * *